US005290980A

United States Patent [19]

Cummings

[11] Patent Number: 5,290,980

[45] Date of Patent: Mar. 1, 1994

[54] ROTARY VACUUM-ELECTRIC SWITCH

[75] Inventor: John G. Cummings, Cary, Ill.

[73] Assignee: Indak Manufacturing Corp., Northbrook, Ill.

[21] Appl. No.: 910,783

[22] Filed: Jul. 8, 1992

[51] Int. Cl.[5] ..... H01H 19/58

[52] U.S. Cl. ..... 200/61.86; 200/11 R

[58] Field of Search ..... 200/11 R, 11 A, 11 D, 200/11 DA, 11 G, 11 T, 61.85, 61.86

[56] References Cited

U.S. PATENT DOCUMENTS 3,862,383 1/1975 Bednarek et al. ..... 200/11 R 4,679,588 7/1987 Rabb et al. ..... 137/560

*Primary Examiner*—A. D. Pellinen

*Assistant Examiner*—Michael A. Friedhofer

*Attorney, Agent, or Firm*—Palmatier & Zummer

[57] ABSTRACT

First and second self-supporting sheet metal contact plates are mounted in an insulating housing, in planes perpendicular to the axis of a driver which is rotatable to a series of detented positions. The driver carries first and second contactors having first and second contact points slidably engaging opposite sides of the plates while also having riders engaging opposite sides of the first contact plate at all times. The driver carries first and second coil springs biasing the contactors against the plates. The first and second plates have first and second sectors with first and second radial edges on opposite sides of a narrow gap across which the points are movable at different radially spaced locations. The points break contact substantially simultaneously with the second edge whereby wear due to electrical arcing is distributed between the radially spaced locations. A third contactor is biased by the second coil spring into sliding engagement with third and fourth contact plates for making and breaking another electrical circuit therebetween. A pinion gear on the driver meshes with and drives a gear rack on a linearly movable vacuum valve for performing vacuum switching functions. The contact plates are clamped between case and cover components of the housing. To facilitate assembly, the first and second plates are initially connected by a narrow temporary web and have rectangularly bent flanges with interlocking hooks remote from the web for strictly limiting relative movement of the plates. The third and fourth plates have a similar web and hooks.

21 Claims, 17 Drawing Sheets

| MODE SELECTOR VACUUM SWITCH | | | | | | | |
|---|---|---|---|---|---|---|---|
| PORT | FUNCTION | DETENT POSITION | | | | | |
| | | PANEL VENT | PANEL FLOOR | OFF | FLOOR | FLOOR DEFROST | DEFROST |
| 221 | RECIRC-F/ | A | A | V | A | A | A |
| 222 | FULL FLOOR | V | V | V | V | A | A |
| 223 | DEF/FLOOR | V | V | V | V | V | A |
| 224 | FULL VENT | V | A | A | A | A | A |
| 226 | SOURCE | V | V | V | V | V | V |
| 227 | VENT/FLOOR | V | V | A | A | A | A |

V=VACUUM, A=ATMOSPHERE

| MODE SELECTOR ELECTRIC SWITCH | | | | | | | | |
|---|---|---|---|---|---|---|---|---|
| TERM | FUNCTION | AMPS | DETENT POSITION | | | | | |
| | | | PANEL VENT | PANEL FLOOR | OFF | FLOOR | FLOOR DEFROST | DEFROST |
| 171 | BATTERY | 4 | NONE | NONE | NONE | NONE | 171 & 172 | 171 & 172 |
| 172 | A/C CLUTCH | | | | | | | |
| 173 | BLOWER | 30 | 173 & 174 | 173 & 174 | NONE | 173 & 174 | 173 & 174 | 173 & 174 |
| 174 | BATTERY | | | | | | | |

FIG. 62

ROTARY VACUUM-ELECTRIC SWITCH

FIELD OF THE INVENTION

This invention relates to a rotary vacuum-electric switch for use on automotive vehicles, particularly in connection with automotive heating and ventilating systems which may also include air conditioning. Certain aspects of the invention are applicable broadly to rotary electrical switches.

BACKGROUND OF THE INVENTION

Vacuum-electric switches have been widely used for controlling the various functions of automotive heating, air conditioning and ventilating systems. Virtually all such systems include a fan or blower for circulating air into the cab of a vehicle. The fan is driven by an electrical motor which is energized and de-energized by the electrical switching components of the vacuum-electric switch. If the vehicle is equipped with air conditioning, the vehicle is provided with an air conditioning compressor which is typically driven by an electrically operable clutch connected between a drive pulley and the air conditioning compressor. A belt extends between the drive pulley and another pulley which is rotated by the engine of the vehicle. The energization of the air conditioning clutch is controlled by additional electrical switching components of the vacuum-electric switch.

The system is typically provided with a variety of dampers or doors whereby the intake and outflow of air to and from the blower may be controlled. Typically, the dampers or doors are adapted to be moved by vacuum operable motors or devices. The supply of vacuum to the vacuum motors is controlled by the vacuum switching components of the vacuum-electric switch.

The general concept of a rotary vacuum-electric switch is disclosed by the Raab and Cobb U.S. Pat. No. 4,679,588, issued Jul. 14, 1987 and assigned to the assignee of the present application. The switch of such patent comprises a rotatable operating shaft connected to a pinion gear which meshes with a linear gear rack on a translatable valve carriage. A silicone rubber valve is movable with the carriage and is adapted to control the supply of vacuum to a variety of ports, adapted to be connected to the various vacuum motors. An electrically insulating switch carriage is rotatable with the shaft and is provided with two electrically conductive contactors which are movable with the electrical carriage along arcuate paths. The contactors are adapted to engage stationary contacts for controlling the energization of the fan motor and the air conditioning clutch. The electrically insulating carriage has an arcuate detent portion formed with a series of detent notches adapted to be engaged by a spring-pressed detent ball.

While the rotary vacuum-electric switch of the above-mentioned patent is functional and operative, it leaves a great deal of room for improvement, particularly as to adaptability to a wide range of applications, compactness and ease of assembly. Another rotary vacuum-electric switch is disclosed in the present applicant's co-pending application, Ser. No. 07/697,592, filed May 8, 1991 and assigned to the assignee of the present application. Here again the switch comprises a rotatable operating shaft which carries a pinion gear meshing with a linear gear rack on a translatable vacuum valve carriage. The switch also comprises a translatable electrical carriage operable in response to rotation of the shaft by a complex gear drive. Fan and clutch switch contactors are mounted on the electrical carriage. The complex gear drive has a tendency to introduce a significant amount of hysteresis into the driving relation between the rotary shaft and the translatable electrical carriage.

OBJECTS OF THE INVENTION

One object of the present invention is to provide a new and improved rotary vacuum-electric switch having electrical contactors which are mounted directly on and rotatable with the rotatable operating shaft or driver so that hysteresis between the shaft and the contactors is negligible.

Another object is to provide such a new and improved rotary vacuum-electric switch having new and improved stationary or fixed electrical contact components which are particularly inexpensive and easy to assemble while still achieving a high degree of accuracy and repeatability in the operation of the rotary electrical switch.

A further object of the present invention is to provide a new and improved vacuum-electric switch of the foregoing character in which the stationary electrical contact components of the switch are made of sturdy sheet metal and are directly supported by the resinous plastic housing components of the switch, so as to minimize the number of components and the cost of the switch.

It is another object of the present invention to provide a new and improved switch of the foregoing character, having a plurality of electrical contactors which are made of sturdy sheet metal and are directly supported by the resinous plastic operating shaft or driver to provide a highly effective and inexpensive construction.

A further object is to provide a new and improved switch of the foregoing character, in which all of the electrical contactors are identical in construction and are interchangeable so as to minimize the cost of the contactors while facilitating the assembly of the switch and minimizing the possibility of erroneous assembly.

SUMMARY OF THE INVENTION

In accordance with the present invention, these and other objects are achieved by providing a rotary electrical switch, comprising a housing, a rotatable driver mounted for rotation in the housing, at least first and second electrically conductive sheet metal contact plates fixedly mounted in the housing and extending in a plane substantially perpendicular to the rotatable driver, first and second electrical terminals connected to the contact plates, first and second electrically conductive sheet metal contactors mounted on the rotatable driver for rotation therewith and for switching engagement with opposite sides of the contact plates, first and second spring means for resiliently pressing the contactors against the opposite sides of the contact plates, stop means on the housing and the rotatable driver for limiting the rotatable driver to a particular angular range of rotary movement, the first contact plate extending around the rotatable driver through an angle corresponding to the entire range of rotary movement of the rotatable driver, each of the contactors having a contact rider projecting therefrom for continuous sliding engagement with the first contact plate throughout the entire range of rotary movement of the rotatable driver, the contactors and the rotatable driver having means for rotating the contactors with the rotatable driver throughout the entire range of rotation thereof, each of the contactors having a radially projecting arm thereon, the first contactor having a first rearwardly projecting contact point on the arm thereof for selective sliding engagement with the front sides of the first and second contact plates, the second contactor having a second forwardly projecting contact point on the arm thereof for selective sliding engagement with the rear sides of the first and second contact plates, the first contact plate having at least a first contact sector thereon for sliding engagement by the first and second contact points on opposite sides thereof, the second contact plate having at least a second contact sector thereon for sliding engagement by the first and second contact points on opposite sides of the second sector, the first and second contact points being located at substantially different radial distances from the axis of the rotatable driver, the first and second sectors having substantially radial edges disposed on opposite sides of a substantially radial gap therebetween, the gap being substantially narrower than the width of the first and second contact points so that the contact points can move smoothly across the gap, the first and second contactors being operative to provide a closed and conductive electrical circuit between the first and second contact plates when the first and second contact points are engaging the second sector, the first and second contact points being operative to break the electrical circuit when the first and second contact points are moved across the gap between the second sector and the first sector due to rotation of the rotatable driver, the first and second contact points being aligned so that the contact points break contact with the second sector substantially simultaneously whereby the wear on the contact points and the second sector due to electrical arcing is distributed evenly between the first and second contact points and between the portions of the second sector engaged by the first and second contact points.

The first and second contactors are preferably the same in construction and are interchangeable, each of the contactors having a forwardly projecting rider and a rearwardly projecting rider corresponding with the rider referred to above, for slidably engaging the first contact plate throughout the angular range of rotation of the rotatable driver and the contactors, each of the contactors having both the first rearwardly projecting contact point and the second forwardly projecting contact point thereon.

The rotatable driver preferably has a contactor-receiving portion of a noncircular cross section for receiving the contactors in a driving relation, each of the contactors having an axial opening therein of a corresponding noncircular shape for receiving the contactor-receiving portion of the rotatable driver.

The rotatable driver is preferably made of an electrically insulating material, such as a suitable resinous plastic material.

The noncircular contactor-receiving portion of the rotatable driver is preferably formed with a plurality of nonsymmetrical splines, the noncircular opening in each of the contactors being formed with a plurality of slots disposed in a nonsymmetrical pattern corresponding with the nonsymmetrical pattern of the splines to insure that each of the contactors is correctly positioned in a unique orientation on the rotatable driver.

The rotary electrical switch preferably includes at least one additional contact sector separated from the first contact sector by an additional narrow gap, the width of the additional gap being substantially narrower than the width of the contact points so that the contact points will move smoothly across the additional narrow gap, the first sector and the additional sector having first and second additional edges on opposite sides of the additional gap, the additional edges being aligned so that the first and second contact points break contact simultaneously with the additional edge on the additional sector whereby the wear is distributed evenly between the portions of the additional sector which are engageable by the first and second contact points, and also between the first and second contact points.

The additional sector may be formed on the second contact plate.

The first and second contactors are preferably provided with respective first and second contact riders for slidably engaging the first contact plate, the first contact rider projecting rearwardly from the first contactor, the second contact rider projecting forwardly from the second contactor.

The first and second contactors are preferably the same in construction and are interchangeable, each of the first and second contactors having both the first and second contact riders thereon, each of the first and second contactors having both the first and second contact points thereon, the first and second contact points being aligned along a radial line and spaced radially at different radial distances from the axis of the contactors.

The rotary switch preferably includes a vacuum switching valve movable in the housing and operable in response to rotation of the driver, the operation of the valve having a particular coordination with the operation of the electrical switch.

The switch preferably includes first and second meshing gear components on the rotatable driver and the vacuum switching valve for operating the valve.

In another aspect, the switch preferably includes vacuum switching means operable by rotation of the rotatable driver in coordination with the switching operations of the contactors, the vacuum switching means comprising vacuum switching channel means in the housing, vacuum port means forming a plurality of vacuum ports connecting with the channel means, vacuum valve means slidable along the vacuum channel means, and meshing gear components on the rotatable driver and the vacuum valve means for causing movement of the vacuum valve means in response to rotation of the rotatable driver. The meshing gear components preferably comprise a pinion gear on the rotatable driver and a meshing gear rack on the vacuum valve means.

The switch preferably includes detent means on the rotatable driver and the housing for establishing a series of detented positions of the rotatable driver.

The housing preferably comprises a front case and a rear cover which is telescopically engageable with the case. The case and the cover preferably have means for securely clamping the first and second contact plates between the case and the cover.

The cover is preferably formed with slots for receiving the first and second electrical terminals whereby the terminals are accessible from outside the cover.

The rotary electrical switch preferably includes third and fourth electrically conductive contact plates spaced along the rotatable driver from the first and second contact plates and aligned in a second plane substantially perpendicular to the axis of the rotatable driver, the third and fourth contact plates having corresponding third and fourth electrical terminals thereon. A third electrically conductive sheet metal contactor is preferably mounted on the rotatable driver for rotation therewith in sliding engagement with the third and fourth contact plates. Spring means are provided including means for biasing the third contactor against the third and fourth contact plates, the third contactor having a third contact rider for slidably engaging the third contact plate throughout the angular range of rotation of the rotatable driver, the third contactor having a corresponding third radially projecting arm thereon, the third arm having a third contact point projecting therefrom for slidably and selectively engaging the third and fourth contact plates, the third and fourth contact plates having at least third and fourth contact sectors thereon for selective engagement by the third contact point.

All of the contactors are preferably mounted on the rotatable driver with the same angular orientation. Moreover, all of the contactors are preferably the same in construction and are interchangeable.

The cover of the housing preferably is formed with third and fourth slots for receiving the third and fourth electrical terminals whereby such terminals are accessible from outside the cover.

The switch preferably includes a first coil spring mounted around the rotatable driver for biasing the first contactor against the first and second contact plates.

Preferably, the switch comprises a second coil spring slidably mounted around the driver and disposed between the second and third contactors for resiliently biasing the second contactor against the first and second contact plates while also resiliently biasing the third contactor against the third and fourth contact plates.

An insulating washer is preferably mounted on the rotatable drive at one end of the second coil spring to prevent the second coil spring from establishing an electrical connection between the second and third contactors.

To facilitate the assembly of the vacuum-electric switch, the first and second contact plates are initially connected by a narrow temporary web. The plates also have rectangularly bent flanges with first and second interlocking hook means thereon at a location remote from the temporary web for strictly limiting relative movement of the plates to avoid any bending of the web. Narrow gaps are formed between the hook means.

The third and fourth contact plates are similarly connected initially by a narrow temporary web and are formed with rectangularly bent flanges having third and fourth interlocking hook means for strictly limiting relative movement of the third and fourth plates. The webs are cut away or otherwise removed in the final stages of the assembly.

BRIEF DESCRIPTION OF THE DRAWINGS

Further objects, advantages and features of the present invention will appear from the following description, taken in connection with the accompanying drawings, in which.

Figure 32A:
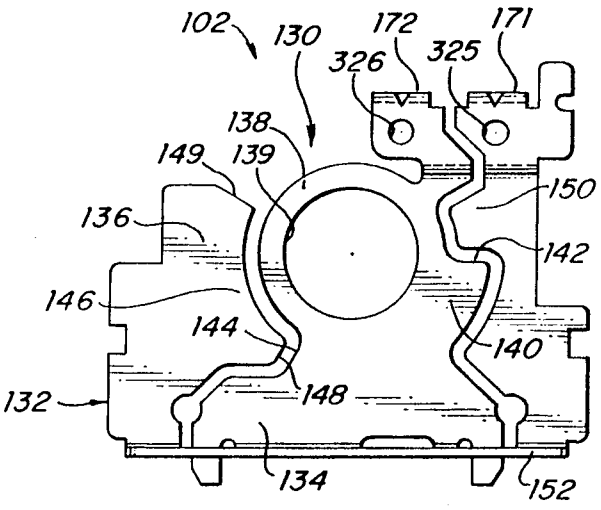
FIG. 32 is a rear elevation of a clutch switch contact and terminal cluster, constituting another component of the switch of FIG. 1.
Figure 32:
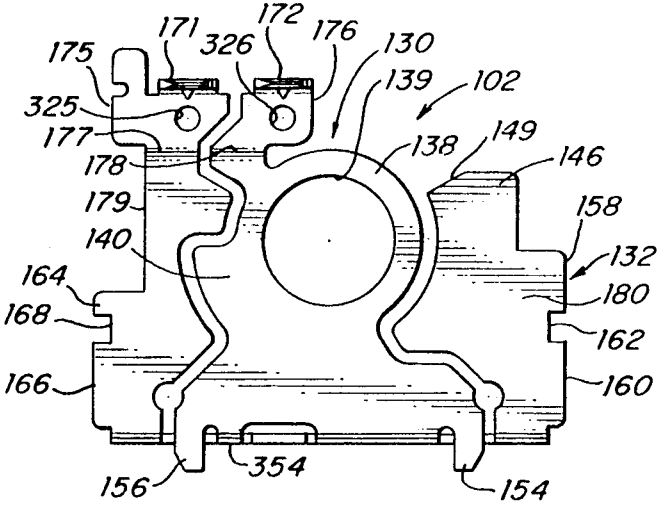

FIG. **32*a* is a front elevation of the cluster of FIG. 32**.

Figure 33:
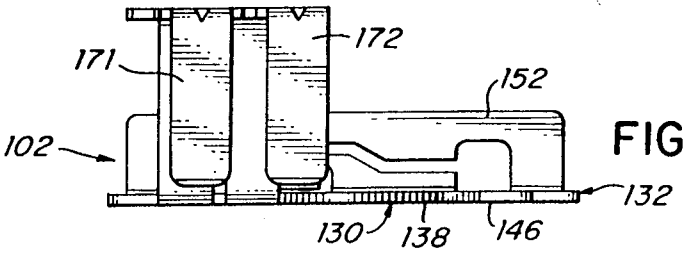

FIG. 33 is a top elevation of the cluster of FIG. 32.

Figure 34:
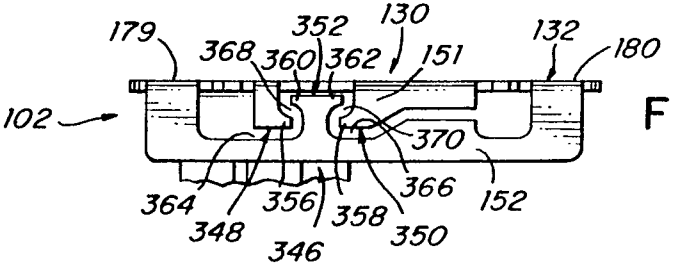

FIG. 34 is a bottom plan view of the cluster of FIG. 32.

Figure 35:
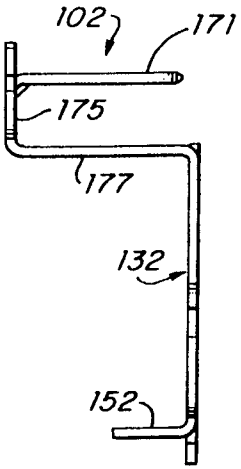

FIG. 35 is a side elevation of the cluster of FIG. 32.

Figure 4:
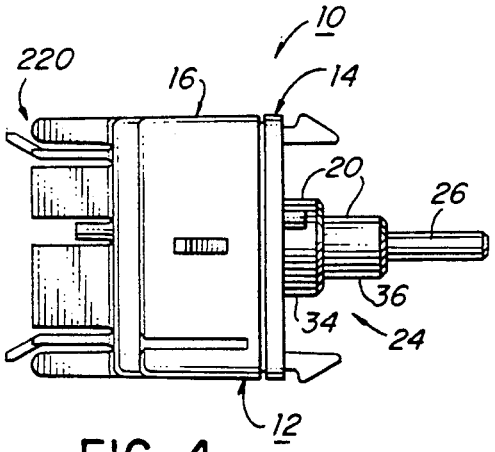
FIG. 4 is a top plan view of the switch.
Figure 1:
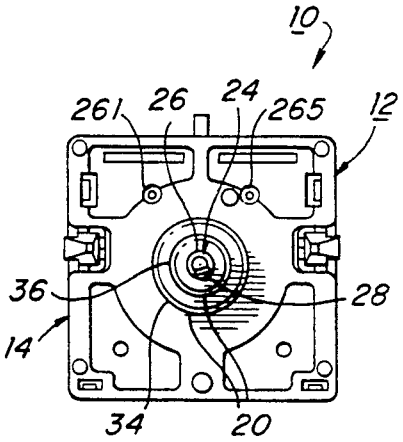
FIG. 1 is a front elevation of a vacuum-electric switch to be described as an illustrative embodiment of the present invention.
Figure 36:
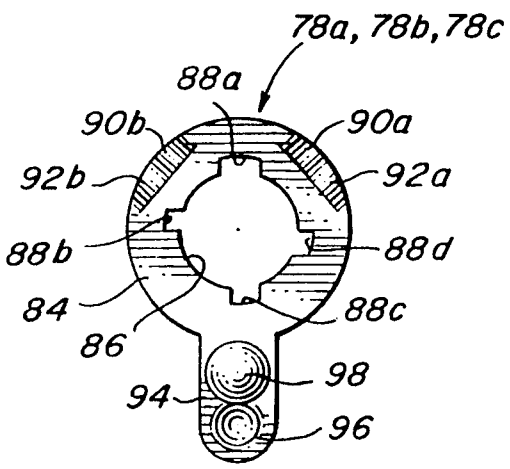

FIG. 36 is a rear elevation of a contactor, three of which are employed in the switch of FIG. 1.

Figure 37:
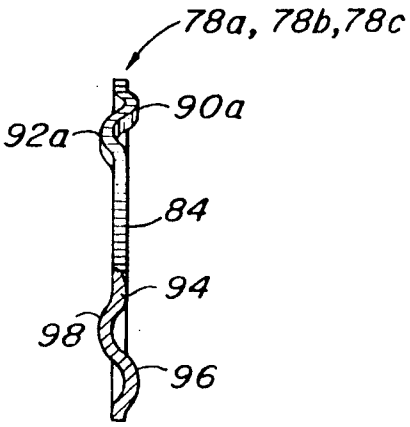

FIG. 37 is a side elevation of the contactor of FIG. 36, partly in a central longitudinal section.

Figure 38:
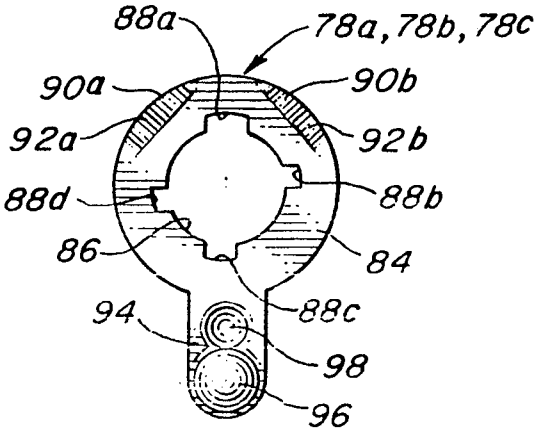

FIG. 38 is a front elevation of the contactor of FIG. 37.

Figure 39:
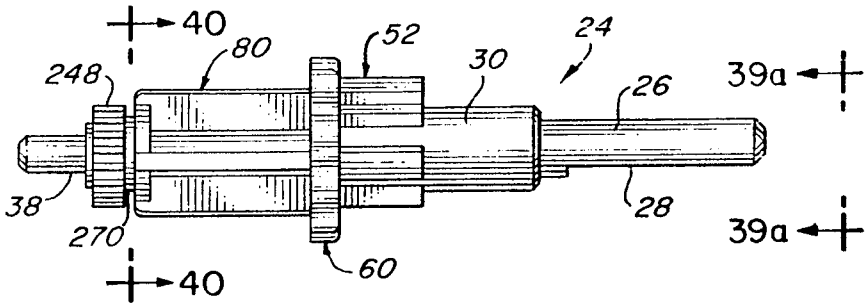

FIG. 39 is an enlarged side elevation of a rotatable driver or shaft constituting another component of the switch of FIG. 1.

FIG. **39*a* is a front elevation of the driver, taken generally as indicated by the line 39*a*—39*a* in FIG. 39**.

Figure 40:
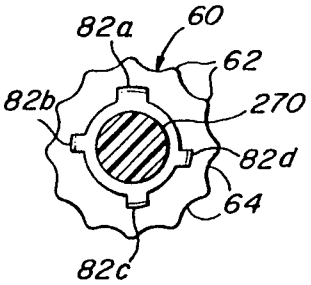

FIG. 40 is a vertical section, taken generally along the line 40—40 in FIG. 39.

Figure 41:
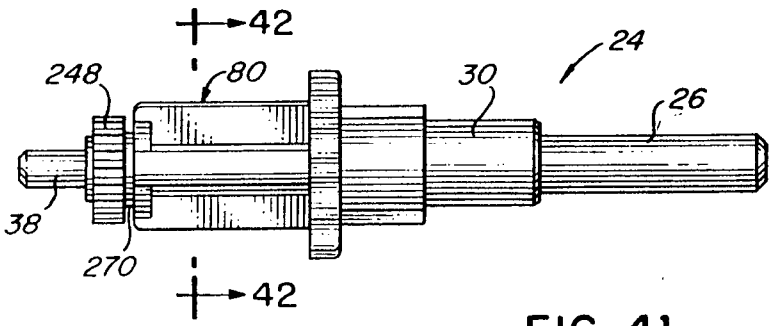

FIG. 41 is an enlarged plan view of the rotatable driver of FIG. 39.

Figure 42:
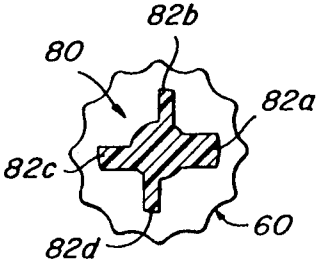

FIG. 42 is a vertical section, taken generally along the line 42—42 in FIG. 41.

Figure 43:
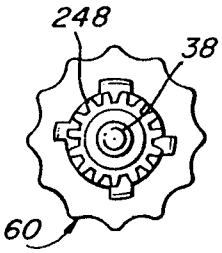

FIG. 43 is a rear end view of the rotary driver of FIG. 39.

Figure 44:
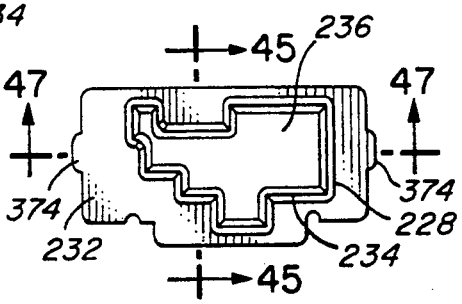

FIG. 44 is an enlarged rear elevation of a valve constituting another component of the switch of FIG. 1.

Figure 45:
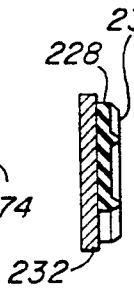

FIG. 45 is a vertical section, taken generally along the line 45—45 in FIG. 44.

Figure 46:
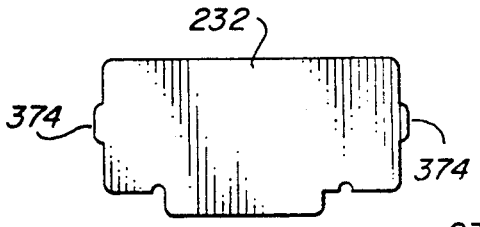

FIG. 46 is a rear elevation of the valve of FIG. 44.

Figure 47:
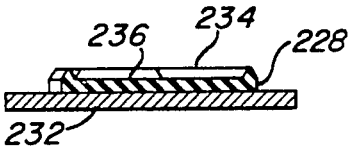

FIG. 47 is a horizontal section, taken generally along the line 47—47 in FIG. 44.

Figure 48:
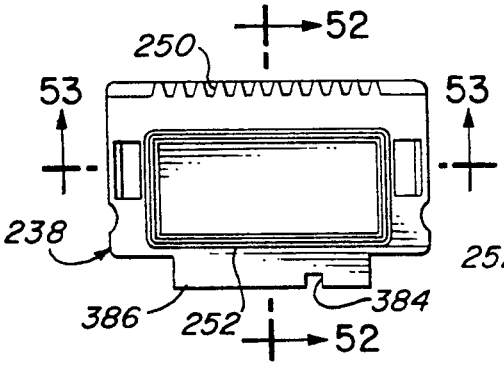

FIG. 48 is a front elevation of a valve carriage employed as another component of the switch of FIG. 1.

Figure 49:
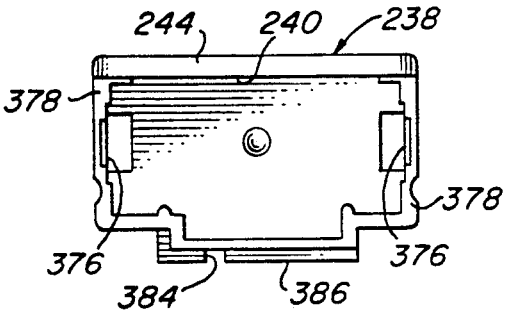

FIG. 49 is a rear elevation of the valve carriage of FIG. 48.

Figure 50:
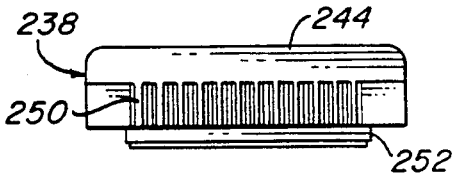

FIG. 50 is a top plan view of the valve carriage.

Figure 51:
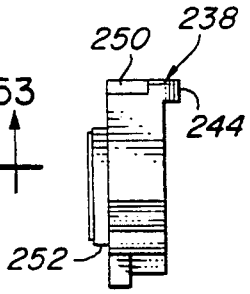

FIG. 51 is a side elevation of the valve carriage.

Figure 52:
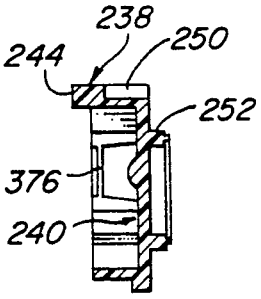

FIG. 52 is a vertical section, taken generally along the line 52—52 in FIG. 48.

Figure 53:
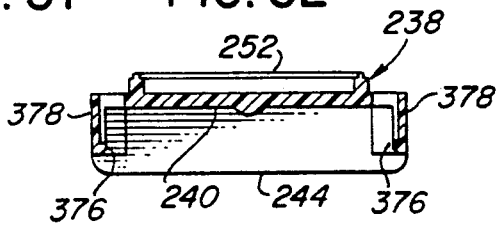

FIG. 53 is a horizontal section, taken generally along the line 53—53 in FIG. 48.

Figure 24:
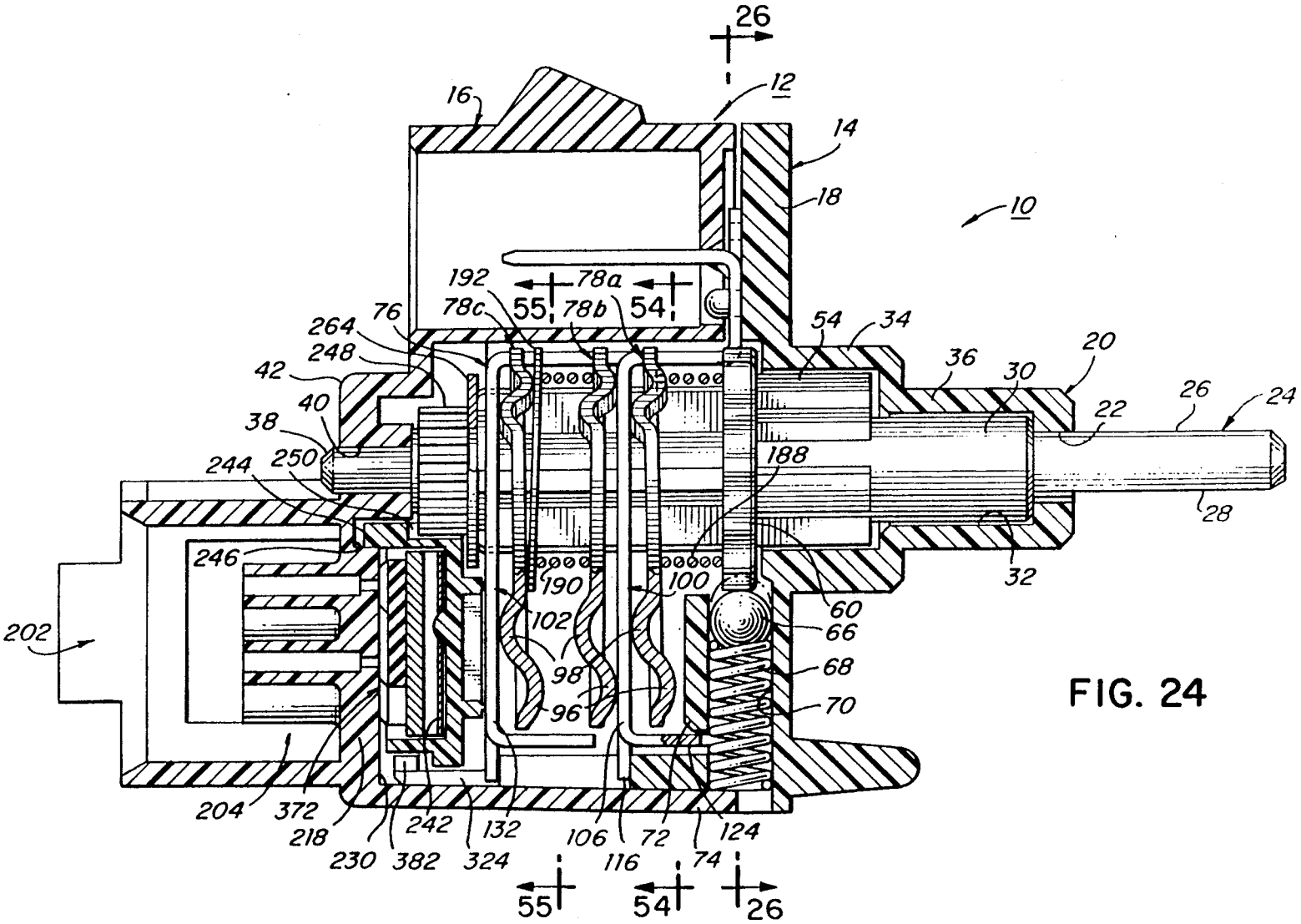
FIG. 24 is an enlarged, central longitudinal section of the assembled vacuum-electric switch of FIG. 1.
Figure 54:
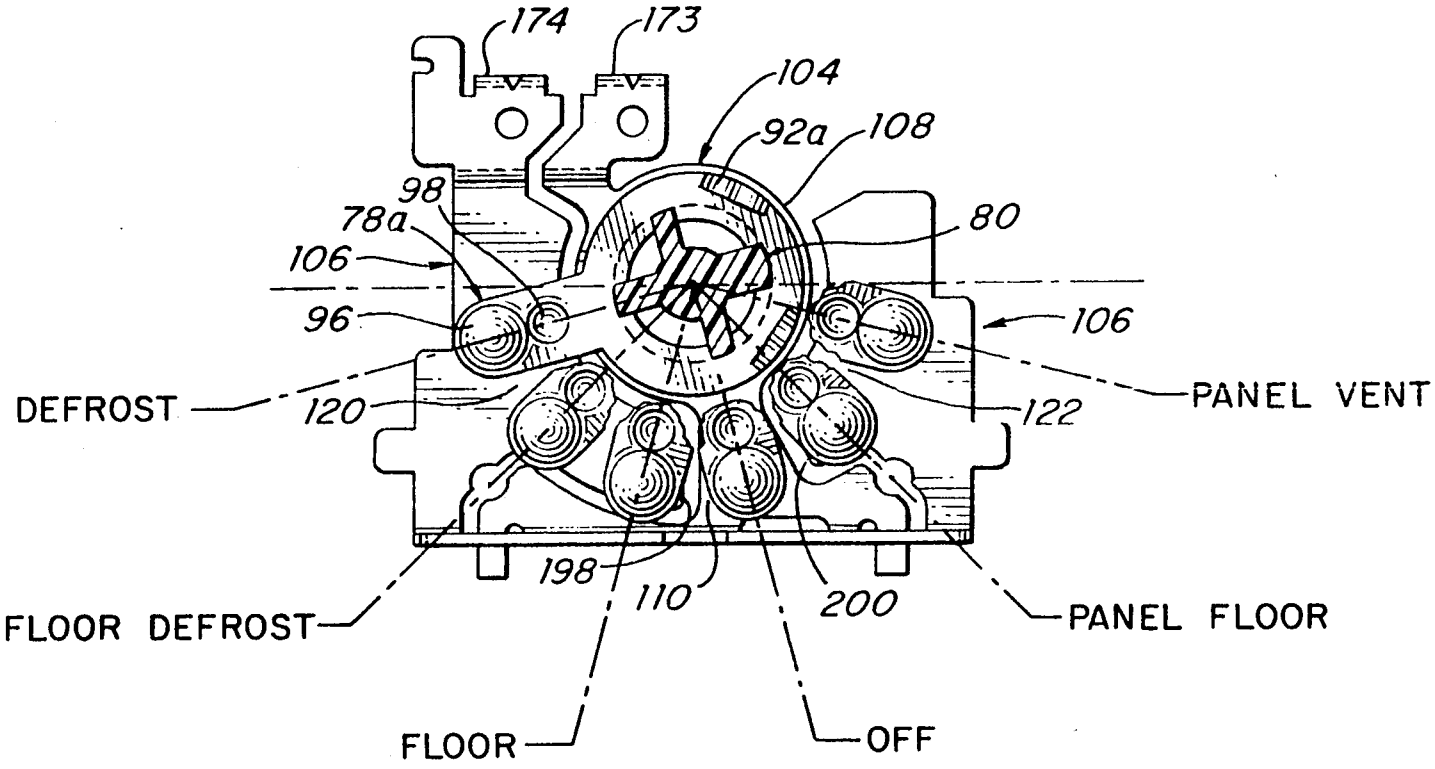

FIG. 54 is a diagrammatic sectional view, taken generally along the line 54—54 in FIG. 24, and showing the various operating positions of the front fan switch contactor, in relation to the contact plates of the fan switch contact and terminal cluster.

Figure 55:
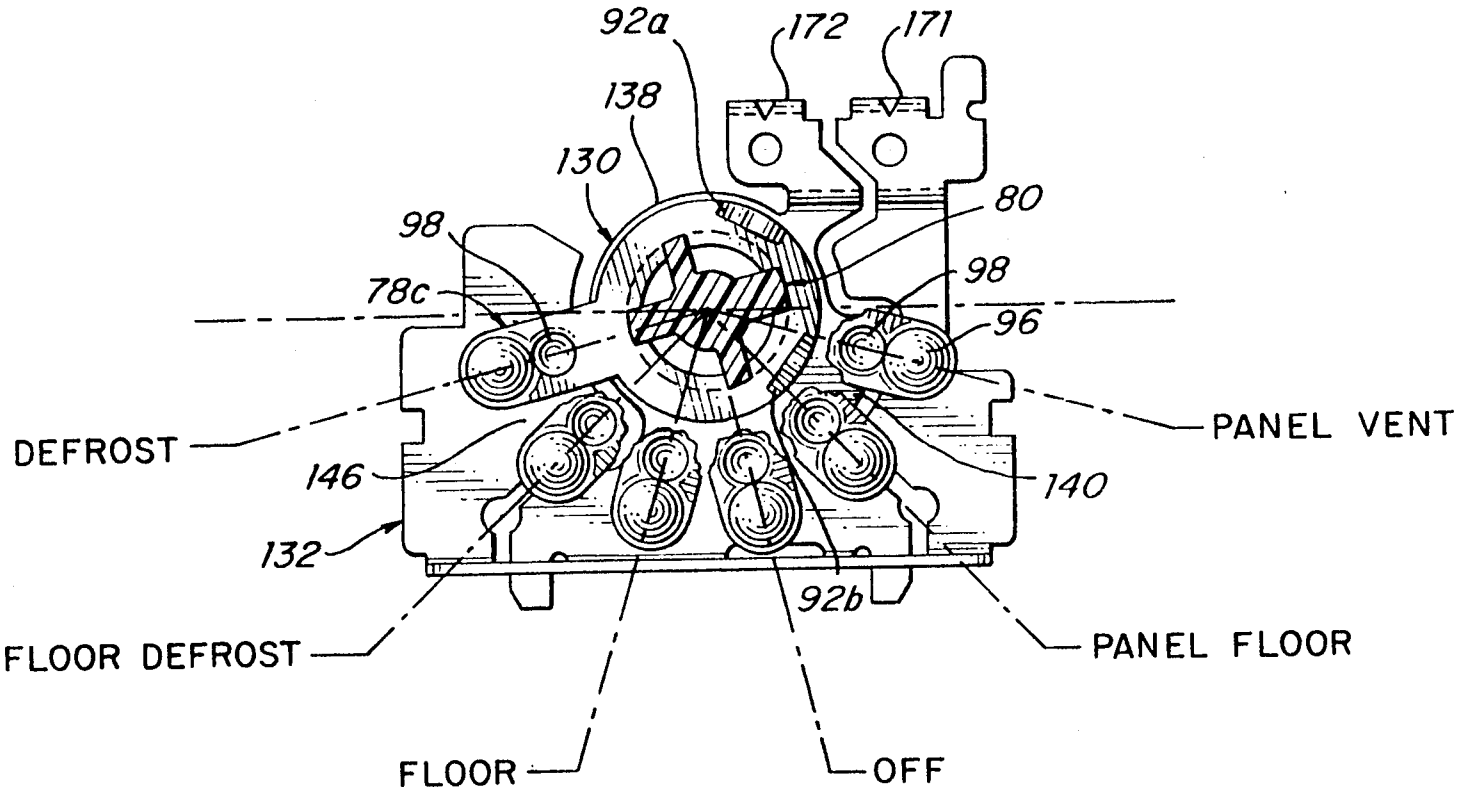

FIG. 55 is a diagrammatic sectional view, taken generally along the line 55—55 in FIG. 24, and showing the various operating positions of the clutch switch contactor, in relation to the contact plates of the clutch switch contact and terminal cluster.

Figure 56:
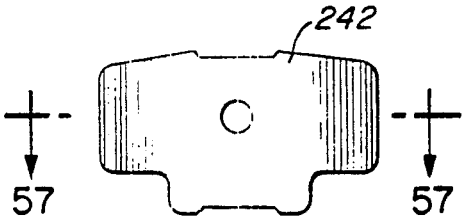

FIG. 56 is an enlarged elevational view of a leaf spring employed in the vacuum valve assembly of the rotary vacuum-electric switch.

Figure 57:
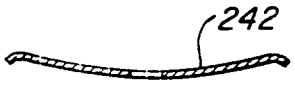

FIG. 57 is a horizontal section, taken generally along the line 57—57 in FIG. 56.

Figure 58:
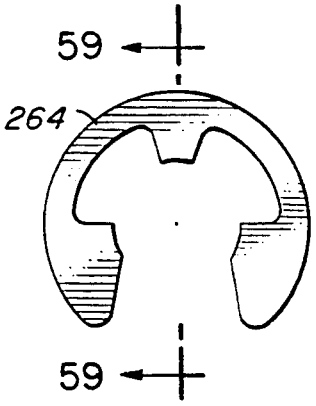

FIG. 58 is an enlarged elevational view of an "E" ring employed as a retainer on the rear portion of the rotatable driver for the vacuum-electric switch.

Figure 59:
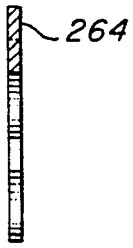

FIG. 59 is a section taken generally along the line 59—59 in FIG. 58.

Figure 60:
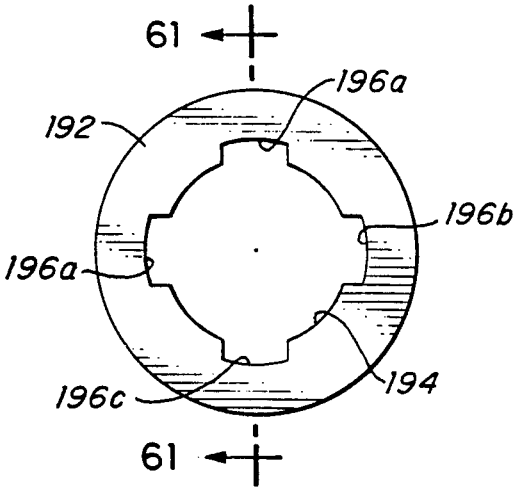

FIG. 60 is an enlarged elevational view of an insulating washer employed on the rotatable driver of the vacuum-electric switch.

Figure 61:
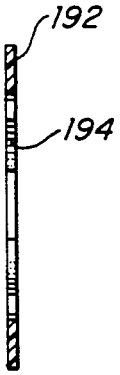

FIG. 61 is a section taken generally along the line 61—61 in FIG. 60.

FIG. 62 is a set of tables or charts showing the functions or modes selected by the vacuum switch and the electric switch of the vacuum-electric switch in its various detented operating positions.

DETAILED DESCRIPTION OF ILLUSTRATIVE EMBODIMENT

As just indicated, the drawings illustrate a rotary vacuum-electric switch 10 (FIGS. 1-5) having a housing 12 comprising front and rear components which will be referred to as a case 14 and a cover 16, made out of electrically insulating material. Each of the components 14 and 16 is preferably molded in one piece from a suitable resinous plastic material, which is mechanically strong and highly resistant to heat. The preferred material for the case 14 is glass-fiber-reinforced nylon. As to the cover 16, the preferred material is ABS plastic having high tensile strength and high heat resistance. The case 14 (FIGS. 6-14) has a front wall 18 formed with a forwardly projecting substantially cylindrical boss 20 having an axial opening 22 therein which is also substantially cylindrical, for receiving a rotatable control shaft or driver 24, made of an electrically insulating material, preferably comprising glass-fiber-reinforced nylon. The illustrated driver 24 has a front shaft portion 26 which is substantially cylindrical but is formed with a longitudinal flat surface 28, whereby the front shaft portion 26 of the driver 24 may be keyed to a knob or the like, not shown, for rotating the driver 24. The cylindrical front shaft portion 26 of the driver 24 is rotatably received in the cylindrical opening 22.

Behind the front shaft portion 26, the driver 24 is formed with an enlarged, substantially cylindrical hub 30 (FIGS. 24 and 41) which is rotatably supported in an enlarged cylindrical bearing surface or opening 32, formed in the boss 20 and connecting with the rear end of the opening 22. The boss 20 is stepped in its outside diameter, in that the boss 20 has a relatively large rear cylindrical portion 34, connecting directly with the front wall 18, and a smaller cylindrical portion 36, in front of the large portion 34.

The driver 24 has a cylindrical, axially disposed rear end shaft portion 38 (FIG. 24) which is rotatably supported in a bearing or opening 40, formed in a rear wall portion 42 of the cover 16 (FIG. 24).

Figure 13:
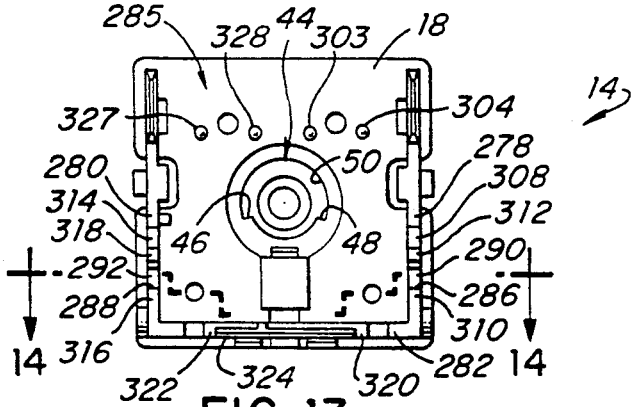
FIG. 13 is a rear elevation of the case of FIG. 6.

The range of rotation of the driver 24 is limited to a predetermined angular range by stop means on the case 14 and the driver 24. As shown in FIG. 13, the case 14 comprises stationary stop means 44 in the form of first and second radial shoulders 46 and 48 at the opposite ends of an arcuate cylindrically curved opening 50, formed in the large portion 34 of the boss 20, to the rear of the cylindrical opening or bearing 32.

Figure 39A:
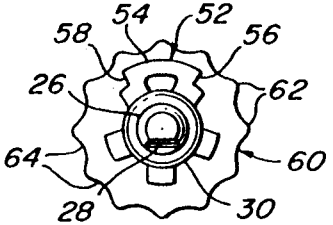

As shown in FIG. 39*a*, the rotatable driver 24 comprises movable stop means 52 in the form of an angular segment 54 projecting outwardly from the driver 24 and having first and second angularly spaced shoulders 56 and 58 facing in opposite directions away from each other for engagement with the first and second shoulders 46 and 48 on the case 14.

Figure 26:
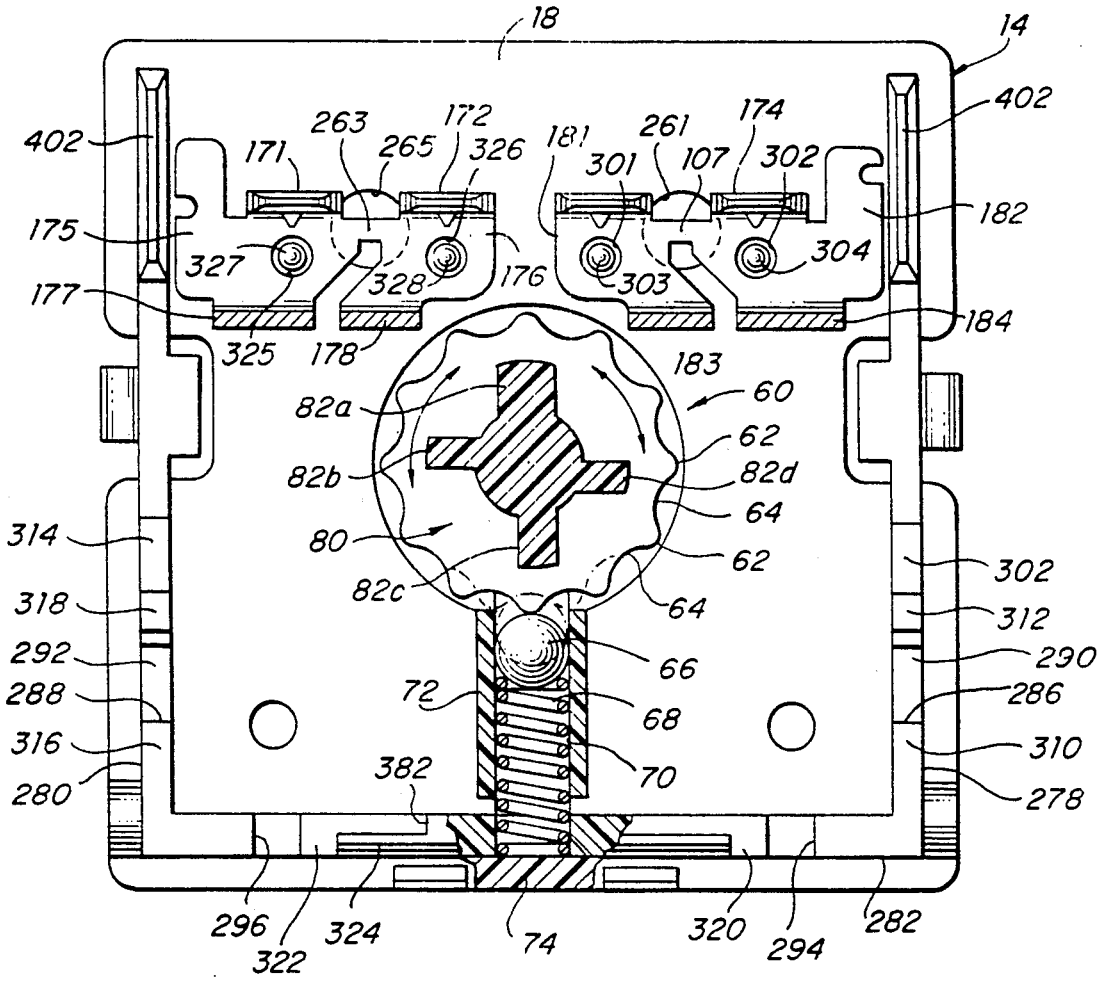
FIG. 26 is an enlarged diagrammatic rear elevation, with portions in section, generally along the line 26—26 in FIG. 24.

As shown in FIGS. 24 and 26, the vacuum-electric switch 10 comprises detent means on the case 14 and the rotatable driver 24 for detaining the driver 24 in a series of detented operating positions. Thus, the rotatable driver 24 comprises detent means in the form of a detent wheel 60 formed in one piece with the rotatable driver 24 and disposed immediately to the rear of the stop segment 54. The detent wheel 60 is formed with a plurality of angularly spaced detent teeth 62 having a series of detent recesses or notches 64, formed in the detent wheel 60 therebetween. The detent means on the case 14 comprise a detent ball 66 which is resiliently biased or pressed against the periphery of the detent wheel 60 by resilient means in the form of a compression coil spring 68. Both the detent ball 66 and the spring 68 are movably received and guided in a generally radial opening 70 formed in a member 72 projecting rearwardly from the front wall 18 of the case 14. Before the cover 16 is telescopically assembled with the case 14, the radially outer or lower end of the opening 70 is fully open so that the detent ball 66 and the coil spring 68 can be inserted into the opening 70. When the cover 16 is fully assembled on the case 14, the radially outer or lower end of the opening 70 is partially closed by a lower wall portion 74 of the cover 16, so that the coil spring 68 is securely retained in the opening 70.

The vacuum-electric switch 10 is provided with electrical switch means 76 operable by the rotatable driver 24 and disposed in the housing 12 to the rear of the detent wheel 60. As shown in FIG. 24, the electrical switch means 76 comprise first, second and third electrically conductive contactors 78*a*, 78*b* and 78*c*, respectively, all three of which are preferably the same in construction so that the contactors are interchangeable. At times herein, the contactors may be referred to simply as 78, for the sake of brevity. All three contactors are received on and rotatable with the rotatable driver 24, which is has a contactor driving portion 80 disposed to the rear of the detent wheel 60.

To provide a driving connection to the contactors 78*a*, 78*b* and 78*c*, the contactor driving portion 80 of the driver 24 has a noncircular, nonsymmetrical cross section. More specifically, the contactor driving portion 80 of the driver 24 is shown with four generally radial longitudinal splines 82*a*, 82*b*, 82*c* and 82*d* which are nonsymmetrical and significantly dissimilar, so that the contactors 78*a*, 78*b* and 78*c* will fit only one way on the splines 82*a*–82*d*. The four splines 82*a*–82*d* are shown in cross section in FIGS. 42, 54 and 55.

The construction of each of the contactors 78*a*, 78*b* and 78*c* is shown in FIGS. 36–38. All three contactors 78*a*–78*c* are the same in construction, so that they are interchangeable. They are made of conductive sheet metal, preferably copper. Each of the contactors 78*a*–78*c* has a central disk-like portion or hub 84 having a generally circular, axial opening 86, the periphery of which is formed with nonsymmetrical radial slots 88*a*, 88*b*, 88*c* and 88*d* for receiving the four splines 82*a*–82*d* with a sliding fit. The reception of the splines 82*a*–82*d* in the slots 88*a*–88*d* provides a rotary driving connection between the rotatable driver 24 and the contactors 78*a*–78*c*.

As shown in FIGS. 36–38, the central disk-like portion 84 of each of the contactors 78*a*–78*c* is formed with a pair of forwardly projecting contact riders 90*a* and 90*b* and a pair of rearwardly projecting contact riders 92*a* and 92*b*, all of which are smoothly rounded for smooth sliding engagement with fixed contact means to be described presently. All of the riders are struck from the sheet metal of the disk-like portion 84. It will be seen from FIGS. 36–38 that the forwardly projecting contact riders 90*a* and 90*b* are immediately adjacent the corresponding rearwardly projecting contact riders 92*a* and 92*b*. When viewed edgewise, as in FIG. 37, the adjacent contact riders 90*b* and 92*b* form a generally S-shaped configuration. The same is true of the riders 90*a* and 92*a*.

Each of the illustrated contactors 78*a*, 78*b* and 78*c* has a substantially radial arm 94 projecting from the disk-like central portion 84. Forwardly and rearwardly projecting contact points 96 and 98 are formed on the opposite sides of the radial arm 94. The illustrated contact points 96 and 98 are spherically rounded in shape and are radially aligned, but are disposed at different distances from the axis of the contactor 78*a*–78*c*. The contact points 96 and 98 are formed from the sheet metal of the radial arm 94. The reverse sides of the contact points 96 and 98 are shown in FIGS. 36 and 38, respectively. When viewed in section, as in FIG. 37, the contact points 96 and 98 are shown in an S-shaped configuration.

Due to the reception of the four splines 82*a*–82*d* in the corresponding radial slots 88*a*–88*d* formed in the three contactors 78*a*, 78*b* and 78*c*, all three of the contactors are keyed to the contactor driving portion 80 of the rotatable driver 24 in exactly the same orientation, so that the radial arms 94 of the three contactors extend in the same radial direction from the driver 24.

The three rotatable contactors 78*a*, 78*b* and 78*c* are engageable with fixed contact means including fan switch contact means and clutch switch contact means, mounted in the housing 12 of the vacuum-electric switch 10. The fan switch contact means takes the form of a fan switch contact and terminal cluster 100, illustrated in FIGS. 27–31. The clutch switch contact means take the form of a clutch switch contact and terminal cluster 102, illustrated in FIGS. 32–35. Both clusters 100 and 102 are made of electrically conductive sheet metal, preferably copper, coated or plated with tin, which stays bright and is not subject to corrosion. The clusters 100 and 102 have portions secured to the case 14 and portions confined between the case 14 and the cover 16, but otherwise the clusters 100 and 102 are self supporting, so that additional supporting means for the clusters are not needed.

Figure 25:
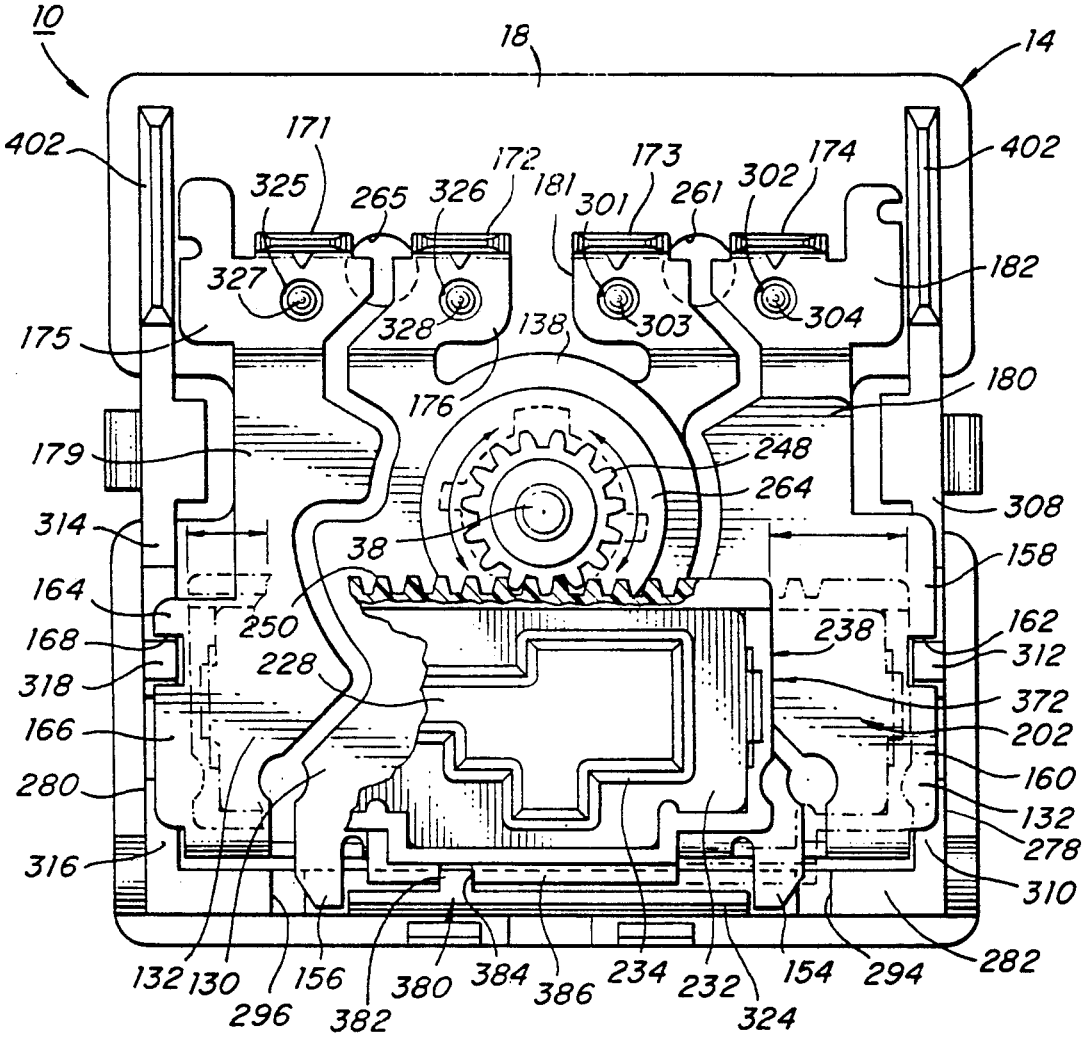
FIG. 25 is an enlarged, somewhat diagrammatic, rear elevation of the switch, with the cover removed and with portions broken away.

As shown in FIGS. 27–31, the fan switch contact and terminal cluster 100 comprises first and second fan switch contact plates 104 and 106 which are engageable by the first and second movable contactors 78*a* and 78*b*. The cluster 100 is initially formed in one piece from pre-tinned copper sheet metal, with a small web 107 between vertical legs 181 and 182 (FIG. 26) connected to the plates 104 and 106, but the web 107 is cut away in the final stages of the assembly of the vacuum-electric switch 10, so that the plates 104 and 106 are separated electrically, as shown in FIG. 25.

The first contact plate 104 has a generally circular ring-shaped portion 108 which is continuously engaged by the contact riders 90*a*, 90*b*, 92*a* and 92*b* of the first and second contactors 78*a* and 78*b*, disposed on opposite sides of the contact plates 104 and 106. Specifically, the first contactor 78*a* is slidably engageable with the front side of the contact plates 104 and 106, while the second contactor 78*b* is engageable with the rear sides of the contact plates 104 and 106. The ring-shaped portion 108 is formed with a circular opening 109 through which the rotatable driver 24 extends with a clearance fit.

The first contact plate 104 also has a radial contact sector 110 which extends outwardly from the ring-shaped portion 108 and is slidably engageable at one detented position of the switch 10 by the rearwardly projecting contact point 98 of the first contactor 78*a* and the forwardly projecting contact point 96 of the second contactor 78*b*, which are engageable with the front and rear sides of the radial contact sector 110. This detented position is the OFF position of the first and second contactors 78*a* and 78*b*, because the contactors are engageable solely with portions of the first contact plate 104.

The first contact plate 104 also has forwardly bent flanges 112 and 114 along the lower edge of the contact plate 104. The flanges 112 and 114 are employed to stiffen the plate 104 and to assist in mounting the plate in the housing 12. Locating tabs 116 and 118 project downwardly from- the lower edge of the contact plate 104, to assist in locating the contact plate in the housing 12.

The second contact plate 106 of the fan switch cluster 100 comprises first and second arcuate contact sectors 120 and 122 which are spaced radially outwardly from the ring-shaped contact portion 108 for sliding engagement by the oppositely directed contact points 98 and 96 of the first and second contactors 78*a* and 78*b*. More specifically, as shown in FIG. 24, the rearwardly projecting contact point 98 of the first contactor 78*a* is slidably engageable with the front sides of the first and second arcuate sectors 120 and 122. The forwardly projecting contact point 96 of the second contactor 78*b* is slidably engageable with the rear sides of the first and second arcuate contact sectors 120 and 122.

The second fan switch contact plate 106 also comprises a forwardly bent flange 124 along the lower portion of the contact plate 106 for connecting the contact sectors 120 and 122 together, both mechanically and electrically. The flange 124 also stiffens the contact plate 106 and is employed in mounting the plate 106 in the housing 12. The contact plate 106 also has locating tabs 126 and 128 projecting laterally from the sectors 120 and 122, to assist in locating the plate 106 in the housing 12.

As shown in FIGS. 32–35, the clutch switch contact and terminal cluster 102 comprises first and second contact plates 130 and 132 which are engageable by the third contactor 78*c*. As shown in FIG. 24, the third contactor 78*c* is engageable with the front surfaces 134 and 136 of the contact plates 130 and 132, the front surfaces being shown in FIG. 32*a*. The rearwardly projecting contact riders 92*a* and 92*b* of the third contactor 78*c* are continuously engageable with a generally circular ring-shaped portion 138 of the first contact plate 130, throughout the range of angular rotation of the contactor 78*c*. The ring-shaped portion 138 is formed with a circular opening 139 through which the rotatable driver 24 extends with a clearance fit. The first contact plate 130 also has an angular contact sector 140, spaced radially outwardly from the generally circular portion 138 for engagement by the rearwardly projecting contact point 98 of the third contactor 78*c*, throughout a considerable angular portion of the range of angular movement of the third contactor 78*c*. The first contact plate 130 has radial edges 142 and 144 which constitute the angular boundaries of the sector 140. When the third contactor 78*c* is positioned so that the rearwardly projecting contact point 98 is engaged with the angular sector 140, the contactor 78*c* is in an OFF position because the contact riders 92*a* and 92*b* and the contact point 98 are all engaged with the same contact plate 130.

The second contact plate 132 has an angular contact sector 146, spaced outwardly from the ring-shaped portion 138 and bounded by radial edges 148 and 149. The rearwardly projecting contact point 98 is engageable with the contact sector 146 for an angular range of positions which are ON positions of the third contactor 78*c*, because the contactor forms a conductive bridge between the first and second contact plates 130 and 132. The second contact plate 132 has another small contact sector 150 which is not used in the case of the illustrated switch 10, but is available for use in other similar related switches.

The first and second contact plates 130 and 132 are formed along their lower edges with forwardly bent stiffening flanges 151 and 152 which also assist in locating the plates 130 and 132 in the housing 12 of the switch 10. The flange 152 on the plate 132 also connects the various portions of the plate 132 together, both mechanically and electrically.

As shown in FIGS. 32 and 32*a*, locating tabs 154 and 156 project downwardly from the lower edge of the first contact plate 130. Along one vertical edge, the second contact plate 132 has locating tabs 158 and 160 with a locating notch 162 therebetween. The other vertical edge of the contact plate 132 is formed with laterally projecting locating tabs 164 and 166 with a locating notch 168 therebetween. The locating tabs 158, 160, 164 and 166, as well as the locating notches 162 and 168, are employed to locate the contact plates 130 and 132 in the housing 12.

Figure 2:
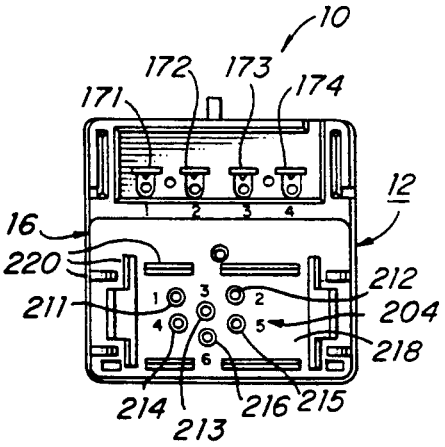
FIG. 2 is a rear elevation of the switch of FIG. 1.
Figure 5:
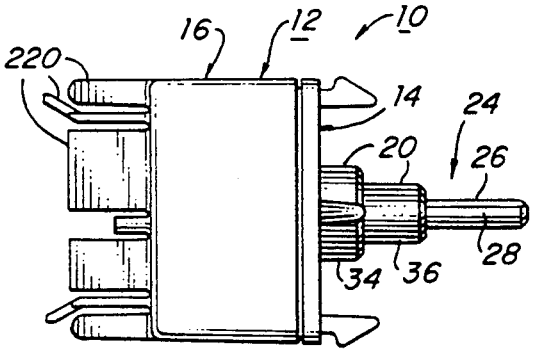
FIG. 5 is a bottom plan view of the switch.
Figure 7:
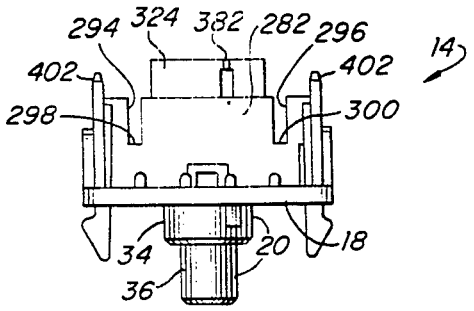
FIG. 7 is a top plan view of the case of FIG. 6.
Figure 6:
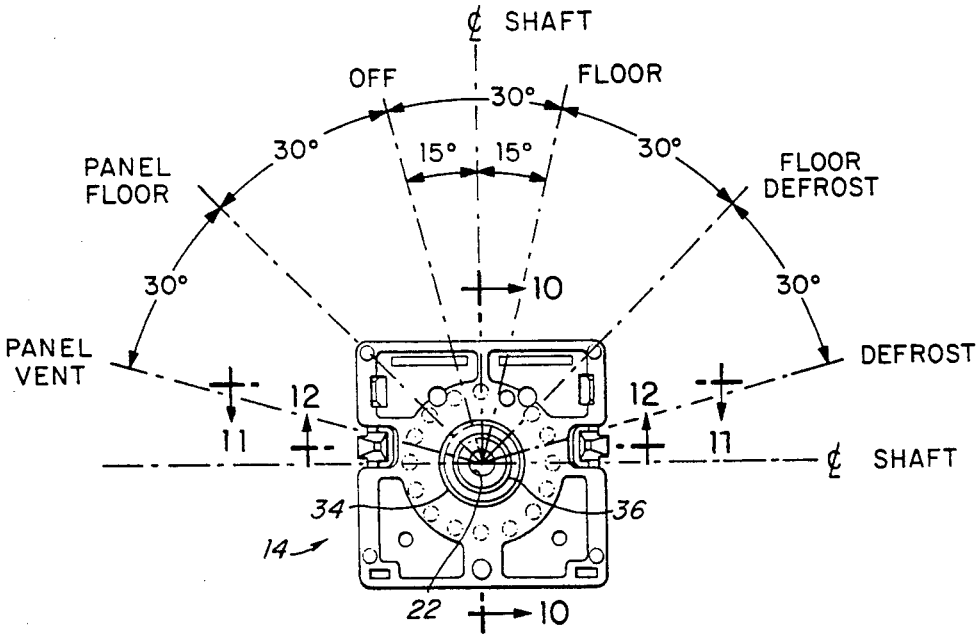
FIG. 6 is a front elevation of a case, constituting a component of the switch of FIG. 1, the view including diagrammatic indications as to the operating positions of the switch.
Figure 10:
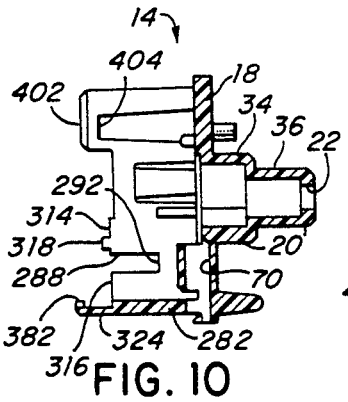
FIG. 10 is a vertical section, taken generally along the line 10—10 in FIG. 6.
Figure 8:
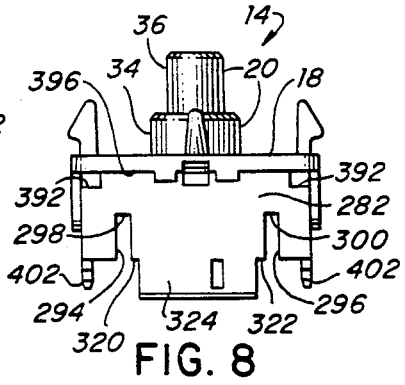
FIG. 8 is a bottom plan view of the case.
Figure 9:
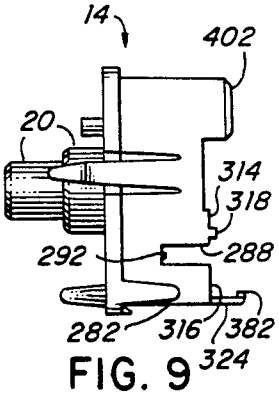
FIG. 9 is a right side elevation of the case.
Figure 11:
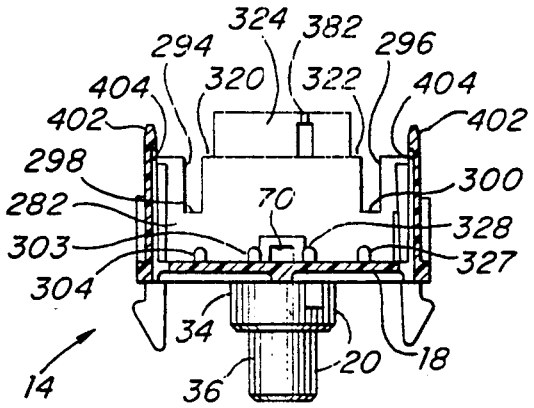
FIG. 11 is a horizontal section, taken generally along the line 11—11 in FIG. 6.
Figure 12:
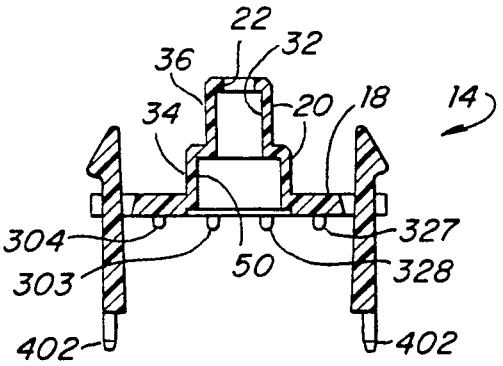
FIG. 12 is a horizontal section, taken generally along the line 12—12 in FIG. 6.

The electrical switch means 76 of the vacuum-electric switch 10 comprise terminal means including four external terminals 171, 172, 173 and 174 illustrated in FIG. 2 as electrically conductive sheet metal prongs projecting rearwardly from the cover component 16 of the housing 12. The terminals 171–174 are adapted to mate with a cable connector, not shown, whereby the terminals are connected to the wiring harness of the automotive vehicle. As shown in FIGS. 32–35, the terminals 171 and 172 are formed in one piece with the contact plates 132 and 130, respectively, of the clutch contact and terminal cluster 102. As shown in FIGS. 27–31, the terminals 173 and 174 are formed in one piece with the contact plates 104 and 106, respectively, of the fan contact and terminal cluster 100.

As shown in FIGS. 32–35, the prong-shaped terminals 171 and 172 are bent rearwardly from respective vertical legs 175 and 176 which are bent upwardly from respective horizontal legs 177 and 178. The horizontal leg 177 is bent rearwardly from a first side portion 179 of the contact plate 132. The leg 178 is bent rearwardly from the clutch contact plate 130. The contact sector 150 is formed on the first side portion 179. The contact plate 132 also has a second side portion 180 on which the contact sector 146 is formed. The first and second side portions 179 and 180 are connected together by the flange 152 which is bent forwardly from the side portions 179 and 180.

As shown in FIGS. 27–31, the prong-shaped terminals 173 and 174 are bent rearwardly from respective vertical legs 181 and 182 which are bent upwardly from respective horizontal legs 183 and 184. It will be seen that the horizontal leg 183 is bent rearwardly from the contact plate 104, while the horizontal leg 184 is bent rearwardly from a first side portion 185 of the contact plate 106. The contact sector 120 is formed on the side portion 185. The contact plate 106 also comprises a second side portion 186 on which the contact sector 122 is formed. The side portions 185 and 186 are connected together by the flange 124 which is bent forwardly from the side portions.

Due to the provision of the detent means, including the detent wheel 60, the detent ball 66 and the compression coil spring 68 for biasing the detent ball 66 against the detent wheel 60, and also due to the provision of the stop means 44 and 52, all as previously described, the rotatable driver 24 and the operating shaft 26 thereon are rotatable to a plurality of detented positions which are angularly spaced throughout the range of rotation of the driver 24. More specifically, as shown diagrammatically and as labelled in FIG. 6, the driver 24 and the shaft 26 are rotatable to six detented positions having the following names:

1. DEFROST
2. FLOOR DEFROST
3. FLOOR
4. OFF
5. PANEL FLOOR
6. PANEL VENT

In this particular switch 10, the spacing between the detented positions is 30 degrees, but the spacing can be varied.

FIG. 54 shows the corresponding six detented positions of the first rotatable fan switch contactor 78*a* relative to the fan switch contact plates 104 and 106. As shown in FIG. 24, the first rotatable contactor 78*a* is positioned in front of the contact plates 104 and 106 and is biased rearwardly against the contact plates 104 and 106 by resilient biasing means, illustrated as a compression coil spring 188, compressed between the detent wheel 60 and the first contactor 78*a*. The coil spring 188 is freely received around the splined driving portion 80 of the rotatable driver 24.

Throughout the range of rotary movement of the first rotatable contactor 78*a*, the rearwardly projecting contact riders 92*a* and 92*b* thereon are slidably engaged with the circular ring-shaped portion 108 of the contact plate 104. Thus, the contactor 78*a* is electrically connected to the first contact plate 104 and also to the terminal 173 in all positions of the contactor 78*a*.

In the first three positions of the first contactor 78*a*, designated DEFROST, FLOOR DEFROST, and FLOOR, the rearwardly projecting contact point 98 of the first contactor 78*a* is slidably engageable with the contact sector 120, which is connected to the terminal 174. Thus, the contactor 78*a* establishes an electrical connection between the terminals 173 and 174. In the OFF position of the contactor 78*a*, the rearwardly projecting contact point 98 thereof engages the contact sector 110 which is connected to the circular ring-shaped portion 108 of the contact plate 104, so that the contactor 78*a* does not establish any external electrical connection.

When the first rotatable contactor 78*a* is in its fifth and sixth detented positions, designated PANEL FLOOR and PANEL VENT, the rearwardly projecting contact point 98 of the contactor 78*a* is slidably engaged with the contact sector 122, which is a portion of the contact plate 106, so that the contactor 78*a* establishes an electrical connection between the terminals 173 and 174. In the typical automotive heating, ventilating and air conditioning system, the terminals 173 and 174 are connected in series with the energizing circuit for the fan motor, so that the fan motor is energized when the contactor 78*a* establishes a conductive connection between the terminals 173 and 174. This occurs in all of the detented positions of the contactor 78*a*, with the exception of the OFF position.

The lower table or chart of FIG. 62, entitled MODE SELECTOR ELECTRIC SWITCH, summarizes the electrical switching functions of the first rotatable contactor 78*a*, as just described. In accordance with the preceding description, the table shows that the BLOWER or fan terminal 173 is connected to the BATTERY terminal 174 in all of the detented positions of the contactor 78*a*, with the exception of the OFF position.

As shown in FIG. 24, the second rotatable contactor 78*b* is positioned immediately behind the fan contact plates 104 and 106 and is lined up with the first rotatable contactor 78*a*. The second rotatable contactor 78*b* is biased forwardly against the contact plates 104 and 106 by resilient biasing means, illustrated in FIG. 24 as a compression coil spring 190, freely received around the splined driving portion 80 of the rotatable driver 24, and compressed between the second rotatable contactor 78*b* and an insulating washer 192 which is pressed against the third rotatable contactor 78*c*, so that the spring 190 also resiliently biases the third rotatable contactor 78*c* rearwardly against the clutch contact plates 130 and 132.

The insulating washer 192 is received on the splined driving portion 80 of the rotatable driver 24 and preferably is rotatable therewith, while being slidable axially thereon. As shown separately in FIGS. 60 and 61, the insulating washer 192 is generally in the form of a circular disk made of an electrically insulating material, such as a suitable resinous plastic material. The washer 192 is formed with a generally circular opening 194 around which four slots or notches 196*a*, 196*b*, 196*c* and 196*d* are formed, for receiving the corresponding splines 82*a*, 82*b*, 82*c* and 82*d* on the rotatable driver 24.

The purpose of the insulating washer 192 is to prevent the coil spring 190 from establishing an electrical connection between the second and third rotatable contactors 78*b* and 78*c*. The insulating washer 192 could be positioned at either end of the coil spring 190, so as to form an insulating barrier or member between the coil spring and one of the rotatable contactors 78*b* and 78*c*.

Because of the forwardly directed force exerted by the coil spring 190 on the second rotatable contactor 78*b*, the forwardly projecting contact riders 90*a* and 90*b* thereon are slidably engaged at all times with the circular ring-shaped portion 108 of the fan contact plate 104, throughout the angular range of rotary movement of the contactor 78*b*.

As already described, FIG. 54 illustrated the six detented positions of the first rotatable contactor 78*a*, which engages the front sides of the contact plates 104 and 106. The second rotatable contactor 78*b* is movable to exactly the same detented positions, except that the second rotatable contactor 78*b* is located behind the contact plates 104 and 106 and is engageable with the rear sides of such contact plates. In the first three detented positions, designated DEFROST, FLOOR DEFROST and FLOOR, the forwardly projecting contact point 96 of the second rotatable contactor 78*b* engages the rear surface of the contact sector 120, so that the second rotatable contactor 78*b* forms an electrically conductive bridge between the circular ring-shaped portion 108 of the contact plate 104 and the contact plate 106. Accordingly, the second rotatable contactor 78*b* affords an electrical connection between the terminals 173 and 174. Indeed, both the first rotatable contactor 78*a* and the second rotatable contactor 78*b* form parallel electrical connections between the terminals 173 and 174, so that the current-carrying ability of the electrical switch means 76 between the fan switch terminals 173 and 174 is at least doubled.

When the second rotatable contactor 78*b* is in its OFF position, its forwardly projecting contact point 96 engages the contact sector 110 which is a portion of the contact plate 104 and is connected to the terminal 173, so that the second rotatable contactor 78*b* does not afford any connection between the terminals 173 and 174.

When the second rotatable contactor 78*b* is in its fifth and sixth detented positions, designated PANEL FLOOR and PANEL VENT, its forwardly projecting contact point 96 engages the contact sector 122 which is a portion of the contact plate 106 and is connected to the terminal 174. Thus, the second rotatable contactor 78*b* forms a conductive electrical connection between the terminals 173 and 174, as indicated by the second table of FIG. 62. Again, the first and second rotatable contactors 78a and 78b form parallel electrical connections between the terminals 173 and 174 so that the combined current-carrying capacity of the electrical switching means 76 between the fan switch terminals 173 and 174 is at least doubled.

Figure 30:
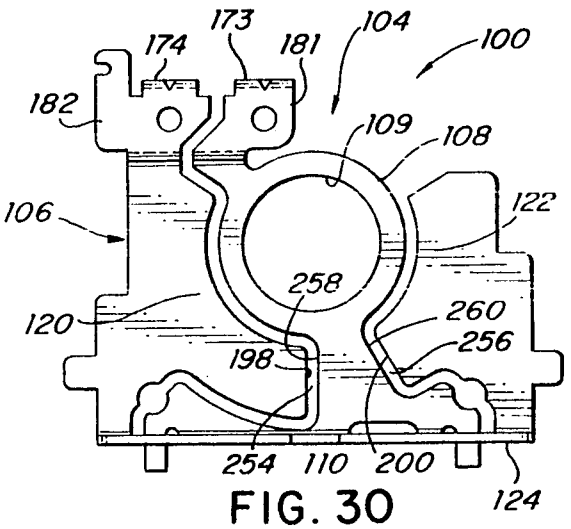
FIG. 30 is a front elevation of the cluster of FIG. 27.

When the first and second rotatable contactors 78a and 78b are moved between their FLOOR and OFF positions, the contact points 98 and 96 thereon, respectively, break contact simultaneously with the contact sector 120 at spaced locations along a radial edge 198 of the contact sector 120, such radial edge being shown in FIGS. 30 and 54. This substantially simultaneous double break action has the important advantage of distributing the wear or attrition, due primarily to electrical arcing, between the two break locations along the radial edge 198, so that the useful life of the contact sector 120 is at least doubled. Moreover, the wear or attrition is also distributed between the contact point 98 on the first contactor 78a and the contact point 96 on the second contactor 78b, so that the useful life of the contactors is also at least doubled.

While the double breaks have been described as simultaneous, they actually only tend to be only approximately simultaneous, due to minor variations and imperfections in the manufactured components, so that the break at one location along the edge 198 tends to occur first, closely followed by a second break at the other location. The electrical arcing occurs primarily at the first break location, so that the wear on the edge 198 occurs primarily at that location. After one or more break cycles, the wear on the edge 198 at that location delays the subsequent breaks at that location, so that the first break tends to occur at the other location, which is consequently subject to greater wear or attrition. Over a long period of time involving many break cycles, the location of the break tends to alternate between the two different locations where the contact points 98 and 96 of the first and second contactors 78a and 78b, respectively, break contact with the edge 198. These two locations are spaced apart radially because the contact points 98 and 96 are spaced apart radially. The alternating double break action greatly prolongs the useful life of the contact sector 120 and the contact points 98 and 96 of the respective first and second contactors 78a and 78b.

A similar double break action occurs when the first and second contactors 78a and 78b are moved between their PANEL FLOOR and their OFF positions. The double breaks occur at radially spaced locations along a radial edge 200 of the contact sector 122, such radial edge being shown in FIGS. 30 and 54. Again, the double breaks are only approximately simultaneous, so that the breaks tend to alternate between the two radially spaced locations along the edge 200. The wear or attrition, due primarily to electrical arcing, is distributed between the two radially spaced locations along the edge 200, and also between the contact points 98 and 96 of the first and second contactors 78a and 78b, respectively. Accordingly, the useful life of the contact sector 122 and the contact points 98 and 96 is at least doubled.

FIG. 55 shows the six detented positions of the third rotatable contactor 78c relative to the clutch switch contact plates 130 and 132. As shown in FIG. 24, the third rotatable contactor 78c is positioned in front of the contact plates 130 and 132 and is biased rearwardly against the contact plates 130 and 132 by the coil spring 190, as previously described. Throughout the range of rotary movement of the third rotatable contactor 78c, the rearwardly projecting contact riders 92a and 92b thereon are slidably engaged with the circular ring-shaped portion 138 of the contact plate 130. Thus, the third contactor 78c is electrically connected to the contact plate 130 and also to the terminal 172 in all positions of the third contactor 78c.

In the first two detented positions, designated DEFROST and FLOOR DEFROST, the rearwardly projecting contact point 98 of the third contactor 78c is slidably engaged with the contact sector 146, which is connected to the terminal 171, designated BATTERY in FIG. 62. The terminals 171 and 174 are separate BATTERY terminals, as shown in FIG. 62, and may be regarded as the first and second BATTERY terminals. Thus, the third contactor 78c establishes an electrical connection between the terminals 171 and 172, so that the air conditioning clutch of the motor vehicle is energized, to activate the air conditioning system. In this way, the air conditioning system is employed to dehumidify the air which is blown upon the windshield of the motor vehicle to accomplish the defrost function.

In the third through the sixth detented positions, designated FLOOR, OFF, PANEL FLOOR and PANEL VENT in FIG. 55, the rearwardly projecting contact point 98 of the third rotatable contactor 78c is slidably engaged with the contact sector 140 on the contact plate 130 which is connected to the terminal 172. Accordingly, the third contactor 78c does not establish any electrical connection between the terminals 171 and 172 in any of these detented positions. While the PANEL FLOOR and PANEL VENT positions are frequently used for air conditioning, a separate switch (not shown) is employed to energize the air conditioning clutch, at the option of the operator of the motor vehicle.

The lower table of FIG. 62, entitled MODE SELECTOR ELECTRIC SWITCH, reflects the operational functions of the third rotatable contactor 78c. Thus, the table shows that the first BATTERY terminal 171 and the A/C clutch terminal 172 are connected together in the detented positions designated FLOOR DEFROST and DEFROST, but are not connected together in any of the other four detented positions of the contactor 78c.

As illustrated in FIGS. 24 and 25, the vacuum-electric switch 10 also comprises vacuum switch or valve means 202, in addition to the electrical switch means 76, already described. The operation of the vacuum valve means 202 is coordinated with the operation of the electrical switch means 76 so that the vacuum modes selected by the vacuum valve means 202 are related to the electrical switch modes selected by the switch means 76. As in the past, the vacuum valve means 202 are employed to control the supply of vacuum to a plurality of vacuum motor devices for operating various movable doors, dampers and flow directing devices so as to control the flow of air in the automotive air control system which may provide heating, ventilating and air conditioning. The vacuum is ordinarily derived from the intake manifold of the engine in the vehicle.

Figure 3:
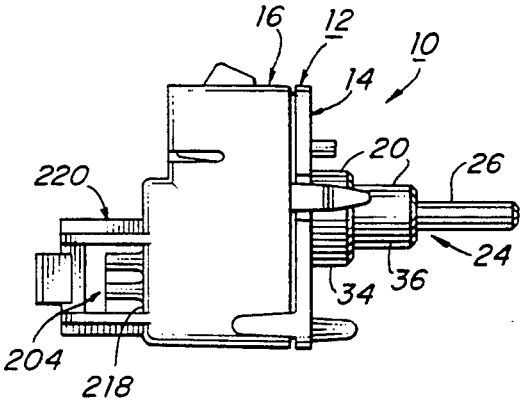
FIG. 3 is a left side elevation of the switch.

The vacuum is supplied to and distributed from the vacuum valve means 202 by an external cluster of vacuum hoses or tubes, terminating in a vacuum connector (not shown) adapted to mate with a nipple cluster 204, projecting rearwardly from the cover 16 of the housing 12. The nipple cluster 204 comprises six hollow tubular nipples 211, 212, 213, 214, 215 and 216 projecting rearwardly from a rear wall 218 of the cover 16, as shown in FIGS. 2 and 3. The rear wall 218 is also formed with a cluster of rearwardly projecting latching and guiding members 220, partially surrounding the nipple cluster 204, in a generally rectangular configuration, for receiving and latching the vacuum connector (not shown).

Figure 20:
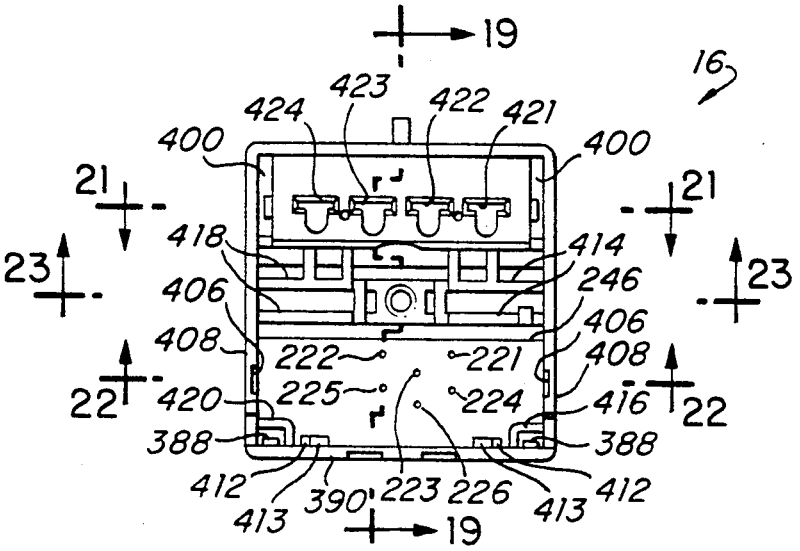
FIG. 20 is a front elevation of the cover.

The nipples 211–216 communicate with port means extending through the rear wall 218 of the cover 16, such port means comprising respective ports 221, 222, 223, 224, 225 and 226, as shown in FIG. 20.

As shown by the upper table of FIG. 62, entitled MODE SELECTOR VACUUM SWITCH, the port 225 is connected to the SOURCE of the vacuum, while the other ports 221–224 and 226 are connected to various vacuum motors and other vacuum utilization devices for operating movable doors, dampers and flow directors in the automotive air control system.

The distribution of vacuum from the source port 225 to the utilization ports 221–224 and 226 is controlled by the horizontal linear movement of a rubber or rubber-like valve 228 (FIGS. 24 and 25) which is slidable along a flat inner or front surface 230 of the rear wall 218, so that the valve 228 traverses the ports 221–226. The valve 228 is preferably made of silicone rubber.

As shown separately in FIGS. 44–47, as well as in the assembly views of FIGS. 24 and 25, the rubber valve 228 is adhesively or otherwise suitably mounted on a substantially rigid backing plate 232, preferably made of metal. To perform the desired valving functions, the rubber valve 228 is molded or otherwise formed with a rearwardly projecting ridge 234 having a closed perimeter which surrounds a valve passage or recess 236 having a complex maze-like shape. Generally, the shape of the ridge 234 and the valve passage 236 is such that the vacuum source port 225 communicates with the valve passage 236 in all positions of the valve 228 along its linear horizontal range of movement. Thus, the valve passage 236 is supplied with vacuum at all times. The other ports 221–224 and 226 communicate selectively with the valve passage 236 and thus are supplied with vacuum in various positions of the valve 228, while being in communication with the atmosphere, outside the perimeter of the ridge 234, in other positions of the valve.

To support the rubber valve 228 and the backing plate 232 for linear movement, the vacuum-electric switch 10 is provided with a valve carriage 238, shown separately in FIGS. 48–53, as well as in the assembly views of FIGS. 24 and 25. The valve carriage 238 is preferably molded in one piece from a suitable resinous plastic material, such as glass-fiber-filled nylon which affords high tensile strength and great resistance to high temperatures. The valve carriage 238 is formed with a rearwardly facing cavity or recess 240 for receiving the backing plate 232 with a free working fit, whereby the backing plate 232 is movable through a limited fore and aft range in the cavity 240. The backing plate 232 and the valve 228 are biased rearwardly by resilient means, illustrated as a generally bow-shaped leaf spring 242, shown separately in FIGS. 56 and 57, as well as in the assembly view of FIG. 24. The leaf spring 242 is received in the cavity 240 and is compressed between the valve backing plate 232 and the valve carriage 238, so that the ridge 234 on the valve 228 is resiliently pressed at all times against the flat surface 230 on the rear wall 218 of the cover 16, so as to maintain the ridge 234 in slidable sealing engageable with the surface 230.

Guide means are provided to guide the valve carriage 238 along a linear horizontal path in the rear cover component 16 of the housing 12, such guide means being illustrated in FIG. 24 as comprising a linear flange or runner 244 projecting rearwardly on the valve carriage 238 along the upper edge thereof. The flange 244 is slidably received in a forwardly facing channel or groove 246 formed in the rear wall 218 of the cover 16 along the upper boundary of the forwardly facing surface 230 which is slidably engaged by the ridge 234 on the rubber valve 228.

The vacuum-electric switch 10 comprises driving means forming a driving connection between the rotatable driver 24 and the linearly movable valve carriage 238, such drive means being illustrated in FIGS. 24 and 25 as comprising a pinion gear 248, molded in one piece on the rotatable driver 24, just in front of the rear end shaft portion 38 thereof, and a linear gear rack 250, meshing with the pinion gear 248, and formed in one piece on the valve carriage 238 along the upper edge portion thereof. The rotatable driver 24 is shown separately in FIGS. 39–43. The valve carriage 238 is shown separately in FIGS. 48–53.

As shown in FIG. 24, the valve carriage 238 is formed with a forwardly projecting runner or flange structure 252 which is slidable in a horizontal direction along the rear sides of the sheet metal contact plates 130 and 132 which are sufficiently smooth and rigid to maintain the valve carriage 238 in its properly assembled position, with the ridge 234 of the rubber valve 228 in slidable sealing engageable with the surface 230. The resilient biasing force produced by the leaf spring 242 presses the valve backing plate 232 rearwardly, while pressing the valve carriage 238 forwardly so that sliding contact is maintained between the forwardly projecting flange structure 252 and the contact plates 130 and 132. In the separate views of the valve carriage 238, the flange structure 252 is shown in FIG. 48 and FIGS. 50–53. The rear surfaces of the contact plates 130 and 132 are shown in FIG. 32.

In the appended claims, references are made to first and second contact plates which are readable on the contact plates 104 and 106. References are also made to third and fourth contact plates which are readable on the contact plates 130 and 132.

Referring to FIGS. 30 and 54, the contact points 98 and 96 of the first and second contactors **78*a* and 78*b* are movable across a narrow gap 254 between the contact sectors 110 and 120. Moreover, the respective contact points 98 and 96 are movable across a second narrow gap 256 between the contact sectors 110 and 122. The gaps 254 and 256 are sufficiently narrow, relative to the size of the contact points 98 and 96, to insure that the contact points 98 and 96 will be smoothly slidable across the gaps. The gap 254 is formed between the radial edge 198 of the contact sector 120 and a radial edge 258 of the contact sector 110. The gap 256 is formed between a radial edge 260 of the sector 110 and the radial edge 200 of the contact sector 122**.

Referring to FIGS. **32*a* and 55, the contact point 98 of the third rotatable contactor 78*c* is slidable across a narrow gap 262 between the radial edge 144 on the contact sector 140 and the radial edge 148 on the contact sector 146. The gap 262 is sufficiently narrow, in relation to the size of the contact point 98, to insure that the contact point 98 will be smoothly slidable across the gap 262**.

In the assembly of the vacuum-electric switch 10, a subassembly is produced of the principal components involved in the electrical switch means 76. The components are assembled in the order shown in FIG. 24.

First, the coil spring 188 is assembled around the contactor driving portion 80 of the rotatable driver 24, with the front end of the coil spring 188 engaging the detent wheel 60. The first rotatable contactor 78*a* is then slipped onto the contactor driving portion 80. The contactor 78*a* is oriented so that the radial slots 88*a*, 88*b*, 88*c* and 88*d* in its axial opening 86 are properly oriented and aligned with the corresponding splines 82*a*, 82*b*, 82*c* and 82*d* on the driving portion 80.

Next, the fan switch contact and terminal cluster 100 is slipped around the contactor driving portion 80 of the rotatable driver 24, so that the contactor driving portion 80 is freely received in the circular opening 109 formed in the ring-shaped portion 108 of the first fan switch contact plate 104. At this stage, the small temporary web 107 (FIG. 26) of sheet metal is still in place between the vertical legs 181 and 182 on the contact plates 104 and 106, so that the plates are still unified in one piece to form the cluster 100. The presence of the temporary web 107 facilitates the assembly of the switching means 76. In the final stages of the assembly, the web 107 is cut away, as shown in FIG. 25, by inserting a tool through an access hole 261 in the front wall 18 of the case 14.

Next, the second rotatable contactor 78*b* is slipped onto the contactor driving portion 80 of the rotatable driver 24. The second contactor 78*b* is oriented so that its radial slots 88*a*, 88*b*, 88*c* and 88*d* are aligned with the corresponding splines 82*a*, 82*b*, 82*c* and 82*d* on the contactor driving portion 80.

Next, the second coil spring 190 is slipped around the driving portion 80. As the assembly progresses, it is necessary to compress the coil springs 188 and 190. The insulating washer 192 is then slipped onto the driving portion 80, followed by the third rotatable contactor 78*c* which must be properly oriented so that its radial slots 88*a*–88*d* are aligned with the corresponding splines 82*a*–82*d* on the contactor driving portion 80.

The clutch switch contact and terminal cluster 102 is then assembled on the driving portion 80 so that the circular opening 139 in the ring-shaped portion 138 of the contact plate 130 is freely received around the driving portion 80. At this stage in the assembly, the vertical legs 175 and 176 of the respective contact plates 132 and 130 are still joined together by a temporary sheet metal web 263 (FIG. 26) which unifies the contact plates 130 and 132 so that the cluster 102 is in one piece. The presence of the temporary web 263 facilitates the assembly of the cluster 102 on the driving portion 80 of the driver 24. In the final stages of the assembly, the web 263 is cut away (FIG. 25) by inserting a tool through an access hole 265 in the front wall 18 of the case 14.

Finally, an E-shaped retaining clip 264 is mounted on the rotatable driver 24, just to the rear of the contactor driving portion 80 and immediately in front of the pinion gear 248, as shown in FIG. 24. The retaining clip 264 retains the contact plate 130 of the clutch switch contact and terminal cluster 102 on the contactor driving portion 80 of the rotatable driver 24, despite the resilient forces exerted by the coil springs 188 and 190.

As shown separately in FIGS. 58 and 59, the E-clip 264 is made of thin resilient sheet metal, such as spring steel, and is of a conventional construction which need not be described in detail herein. The E-clip 264 can be slipped into a groove 270 in the rotatable driver 24. As illustrated in FIGS. 39–41, which show the rotatable driver 24 separately, the groove 270 is formed in the driver 24 immediately behind the contactor driving portion 80 and immediately in front of the pinion gear 248.

In the continued assembly of the vacuum-electric switch 10, the subassembly as just described is inserted into the open rear end of the case component 14 of the housing 12. The front shaft portion 26 of the rotatable driver 24 is inserted through the axial opening 22, while the enlarged hub 30 is inserted into the enlarged bearing opening 32. The stop segment 52 on the rotatable driver 24 is inserted into the arcuate cylindrically curved stop opening 50 in the case 14.

The first and second fan switch contact plates 104 and 106 of the fan switch contact and terminal cluster 100 are inserted into the open rear end of the case 14. As shown in FIG. 24 and as previously described, the case 14 has a front wall 18. As shown in FIGS. 25 and 26, the case 14 also has a pair of side walls 278 and 280 and a lower wall 282, all projecting rearwardly from the front wall 18. The case 14 is also shown separately in FIGS. 6–14. The rear view of FIG. 13 shows the walls 18, 278, 280 and 282 which bound the space into which the fan switch contact and terminal cluster 100 is inserted.

Figure 14:
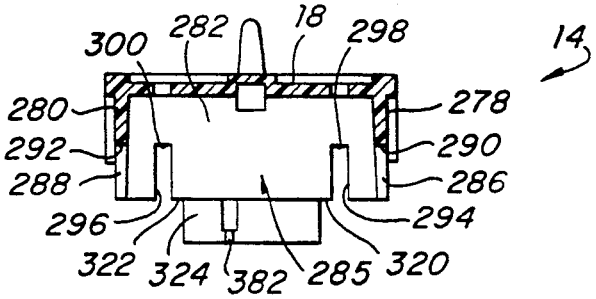
FIG. 14 is a horizontal section, taken generally along the line 14—14 in FIG. 13.
Figure 16:
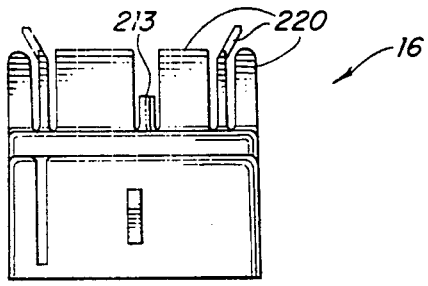
FIGS. 16 and 17 are top and bottom plan views of the cover.

With reference to FIGS. 13, 14, 25 and 27–31, the first and second contact plates 104 and 106 fit into a generally rectangular opening 285 bounded by the walls 278, 280 and 282 of the case 14 and are movable forwardly into such opening. The flange 124 on the contact plate 106 is formed with a semicircular notch 284 (FIG. 29) which affords clearance for the detent ball 66 and its biasing spring 68. The laterally projecting locating tabs 126 and 128 on the second contact plate 106 are movable forwardly along slots 286 and 288 in the side walls 278 and 280 until the tabs 126 and 128 seat against shoulders or front edges 290 and 292 at the front ends of the slots 286 and 288 (FIG. 14). The downwardly projecting locating tabs 116 and 118 on the contact sector 110 of the first contact plate 104 are movable forwardly along corresponding slots 294 and 296 in the lower wall 282 of the case 14, until the tabs 116 and 118 seat against shoulders or front edges 298 and 300 (FIG. 14).

Figure 27:
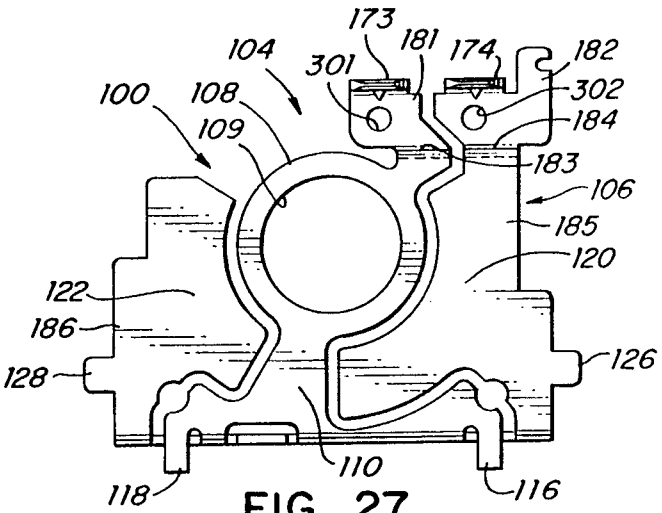
FIG. 27 is a rear elevation of a fan switch contact and terminal cluster, constituting another component of the switch of FIG. 1.
Figure 31:
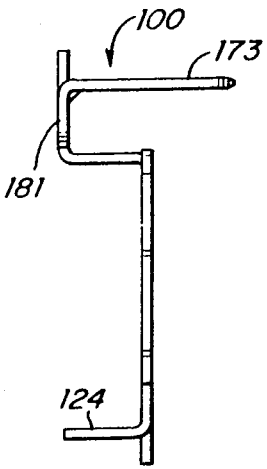
FIG. 31 is a side elevation of the cluster of FIG. 27.

As previously described, the terminals 173 and 174 are formed on the first and second contact plates 104 and 106 at the upper extremities thereof and are bent rearwardly from vertical legs 181 and 182, as shown in FIGS. 27 and 31. As illustrated in FIGS. 24, 25 and 26, the legs 181 and 182 also serve as mounting components, in that they engage the rear side of the front wall 18 of the case 14. The legs 181 and 182 are formed with respective circular openings 301 and 302 for receiving respective mounting pins 303 and 304 projecting rearwardly from the front wall 18 and molded in one piece therewith. If desired, the pins 303 and 304 may be upset or squashed by the application of heat and pressure, for retaining the legs 181 and 182, after they are mounted on the pins 303 and 304.

Referring to FIGS. 13, 24, 25, 26 and 32–35, the third and fourth contact plates 130 and 132 of the clutch switch contact and terminal cluster 102 are also supported by the case 14 of the housing 12. As shown in FIG. 24, the contact plates 130 and 132 are spaced rearwardly from the contact plates 104 and 106 and are mounted at the rear of the case 14. More specifically, the locating tabs 158 and 160 on the second side portion 180 of the contact plate 132 are engaged with rear edge portions 308 and 310 of the side wall 278 on the case 14 (FIGS. 13 and 25). The side wall 278 is formed with a rearwardly projecting locating tab 312 for reception in the locating notch 162, formed in the contact plate 132 between the locating tabs 158 and 160.

The locating tabs 164 and 166 on the first side portion 179 of the contact plate 132 are engaged with respective rear edge portions 314 and 316 of the side wall 280 on the case 14 (FIGS. 13 and 25). The side wall 280 is formed with a rearwardly projecting locating tab 318 for reception in the locating notch 168, formed in the contact plate 132 between the locating tabs 164 and 166.

The locating tabs 154 and 156 which project downwardly from the contact plate 130, as shown in FIG. 32 are engageable with rear edge portions 320 and 322, respectively, on the lower wall 282 of the case 14. When the contact plates 130 and 132 are assembled on the case 14, the locating tabs 154 and 156 are engageable with opposite sides of a flange 324, projecting rearwardly from the lower wall 282 and located centrally thereon.

As previously described, the terminals 171 and 172 are formed on the respective contact plates 132 and 130 at the upper extremities thereof and are bent rearwardly from vertical legs 175 and 176, as shown in FIGS. 32-35. As illustrated in FIGS. 24, 25 and 26, the legs 175 and 176 also serve as mounting components, in that they engage the rear side of the front wall 18 of the case 14. The legs 175 and 176 are formed with respective circular openings 325 and 326 for receiving respective mounting pins 327 and 328 projecting rearwardly from the front wall 18 and molded in one piece therewith. If desired, the pins 327 and 328 may be upset or squashed by the application of heat and pressure, for retaining the legs 175 and 176, after they are mounted on the pins 327 and 328.

Figure 28:
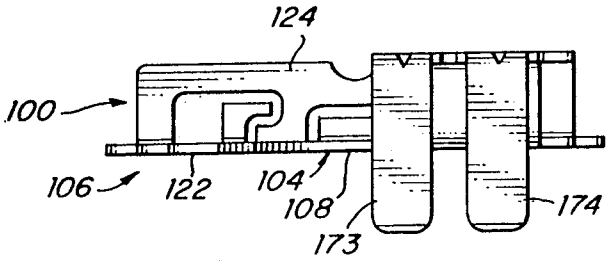
FIG. 28 is a top plan view of the cluster of FIG. 27.
Figure 29:
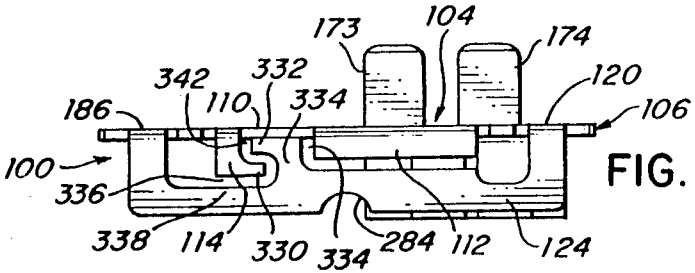
FIG. 29 is a bottom plan view of the cluster of FIG. 27.

As previously described, and as illustrated in FIG. 26, the vertical legs 181 and 182 of the first and second contact plates 104 and 106 are initially joined by a temporary narrow sheet metal web 107, so that the first or fan switch contact and terminal cluster 100 is formed in one piece, whereby the assembly of the cluster 100 on the rotatable driver 24 is greatly facilitated. As an important additional construction to facilitate the assembly, the contact plates 104 and 106 are formed with additional interlocking or interengageable means for preventing or limiting the bending of the web 107 due to the handling of the contact plates 104 and 106 during the various assembly procedures. As illustrated in FIGS. 28 and 29, such interlocking or interengageable means are in the form of interengageable hooks or tabs 330 and 332 on the flanges 114 and 124 which are bent forwardly on the lower portions of the contact plates 104 and 106, as previously described. The tab 330 projects laterally in one direction from the flange 114, so that the flange 114, with the tab 330 thereon, constitutes a generally L-shaped hook. The tab 332 projects laterally in the opposite direction on a small flange 334 projecting rearwardly on the larger flange 124, so that the flange 334, with the tab 332 thereon, constitutes a second L-shaped hook. The tabs 330 and 332 are interlocking in the sense that the tab 330 is engageable with the tab 332 if the contact sector 110 of the contact plate 104 is swung or bent rearwardly to a slight extent, so that the tabs 330 and 332 strictly limit any rearward swinging or bending movement of the contact plate 104 relative to the contact plate 106.

As shown in FIG. 29, a narrow gap 336 is provided between the flange 114 on the first contact plate 104 and a portion 338 of the flange 124 on the second contact plate 106. Thus, the flange portion 338 is spaced a short distance forwardly from the flange 114. Any slight forward movement of the contact sector 110 on the first contact plate 104 will cause the flange 114, and also the tab 330, to engage the flange portion 338, so that forward movement of the contact sector 110 is strictly limited during the assembly procedure. In this way, bending of the temporary sheet metal web 107 is strictly limited, whereby the first contact plate 104 will be maintained in its initial relationship with the second contact plate 106 throughout the assembly procedure.

A narrow gap 342 is provided between the flange 114 and the tab 332, so that rightward movement of the flange 114 is strictly limited. Similarly, a narrow gap 344 is provided between the flange 334 and the flange 112 on the first contact plate 104. In this way, leftward movement of the flange 112 is strictly limited. This construction also maintains the initial relationship between the first and second contact plates 104 and 106 and prevents bending of the temporary web 107 during the assembly procedure. Thus, the assembly is facilitated, and the quality of the assembly is maintained.

As previously described, and as illustrated in FIG. 26, the respective vertical legs 176 and 175 of the corresponding third and fourth contact plates 130 and 132 are initially joined by a temporary narrow sheet metal web 263, so that the second or clutch switch contact and terminal cluster 102 is formed in one piece, whereby the assembly of the cluster 102 on the rotatable driver 24 is greatly facilitated. As an important additional construction to facilitate the assembly, the contact plates 130 and 132 are formed with additional interlocking or interengageable means 346 for preventing or limiting the bending of the web 263 due to the handling of the contact plates 130 and 132 during the various assembly procedures. As illustrated in FIGS. 32 and 34, such interlocking or interengageable means 346 are in the form of interengageable hooks or tabs 348, 350 and 352 on the contact plates 130 and 132. More specifically, as illustrated in FIG. 34, the hook 348 is L-shaped and is bent forwardly on a lower edge portion 354 of the contact plate 130, remote from the temporary web 263. The hook 348 has an extremity or tab 356 directed to the right as shown in FIG. 34. The hook 350 is in the form of a hook-shaped formation on the previously described flange 151, bent forwardly from the lower portion of the contact plate 130. The hook 350 has a tab or extremity 358 projecting laterally to the left, as shown in FIG. 34. The hook 352 is shown in FIG. 34 as a generally T-shaped double hook projecting rearwardly from the previously described flange 152 which projects forwardly from the lower portion of the contact plate 132. The double hook 352 has a first tab or extremity 360, projecting to the left and overlapping or interlocking with the tab 356 on the hook 348. The double hook 352 also has a second tab or extremity 362 projecting to the right and overlapping or interlocking with the tab 358 on the hook 350.

The interlocking or overlapping hooks 348, 350 and 352 strictly limit flexing or bending movement of the contact plate 130 relative to the contact plate 132, so as to prevent bending of the temporary web 263 and thereby to maintain the original relationship of the contact plates 130 and 132 while they are being assembled on the rotatable driver 24. If the lower portion of the contact plate 130 is moved rearwardly relative to the lower portion of the contact plate 132, the tabs 356 and 358 on the respective hooks 348 and 350 engage the tabs 360 and 362 on the double hook 352, so that the rearward movement is strictly limited. If the lower portion of the contact plate 130 is moved forwardly relative to the lower portion of the contact plate 132, the hooks 348 and 350 will engage confronting portions 364 and 366 of the previously described flange 152, bent forwardly from the contact plate 132.

A narrow gap 368 is formed between the hooks 348 and 352. Similarly, a narrow gap 370 is formed between the hooks 350 and 352. By virtue of this construction, the hooks 348, 350 and 352 are effective to impose strict limits on any lateral shifting movement of the lower portion of the contact plate 130 relative to the lower portion of the contact plate 132. If the contact plate 130 is shifted slightly to the right (FIG. 34), the hook 348 will engage the hook 352 so that such movement is strictly limited. If the contact plate 130 is moved slightly to the left, the hook 350 will engage the hook 352, so that such movement is strictly limited.

The hooks 348, 350 and 352 are remote from the temporary web 263 between the contact plates 130 and 132, so that the hooks 348, 350 and 352 cooperate with the web 263 to maintain the original relationship between the contact plates 130 and 132 during the assembly of the contact plates on the rotatable driver 24, as previously described. Thus, the assembly is greatly facilitated and the quality of the assembly is maintained.

As previously described, the vacuum-electric switch 10 is assembled by producing a subassembly comprising the rotatable driver 24, the first coil spring 188, the first rotatable contactor 78*a*, the first or fan switch contact and terminal cluster 100, the second rotatable contactor 78*b*, the second coil spring 190, the insulating washer 192, the third rotatable contactor 78*c*, the second or clutch switch contact and terminal cluster 102, and the E-clip 264. The subassembly is then inserted into the case 14 as previously described and as generally illustrated in FIGS. 24 and 25.

At this stage in the assembly, the case 14 and the previously described subassembly are mounted in an assembly fixture (not shown) which stabilizes the position of the case 14 and insures that the rotatable driver 24 is positioned and maintained in a predetermined angular position.

The next step in the assembly is to produce a valve subassembly 372, shown in FIGS. 24 and 25. To produce the valve subassembly 372, the bow spring 242 is inserted into the cavity 240 in the valve carriage 238. The backing plate 232, with the rubber valve 228 adhesively secured thereto, is pushed into the cavity 240 in the valve carriage 238, against the resilient resistance afforded by the bow spring 242. The backing plate 232 has a pair of laterally projecting tabs 374 which are adapted to be pushed into the cavity 240 in the valve carriage 238, past a pair of latching lips 376 on opposite side walls 378 of the valve carriage 238. The side walls 378 spring outwardly to provide for the movement of the tabs 374 past the latching lips 376, which retain the backing plate 232 with the bow spring 242 in a partially compressed position.

The valve subassembly 372 is then added to the assembly in a position such that the linear gear rack 250 on the valve carriage 238 is properly meshed with the pinion gear 248, as shown in FIG. 25, and so that the forwardly projecting runner 252 on the valve carriage 238 is engaging the rear sides of the clutch switch contact plates 130 and 132.

Alignment or locating means 380 (FIG. 25) are provided to insure that the valve subassembly is properly positioned, so that the linear gear rack 250 on the valve carriage 238 is correctly meshed with the pinion gear 248. In general, the alignment means 380 are constructed and arranged in the manner disclosed and claimed in the applicant's co-pending U.S. patent application, Ser. No. 07/697,592, filed May 8, 1991.

Specifically, the alignment means 380 comprise a small locating tab 382 projecting upwardly from the rear extremity of the flange 324 projecting rearwardly on the lower wall 282 of the case 14, as shown in FIGS. 13 and 14. The alignment means 380 also comprise a locating slot 384 formed in a downwardly projecting flange 386 on the valve carriage 238, as shown separately in FIGS. 48 and 49. When the vacuum-electric switch 10 is fully assembled, the flange 386 is in front of the tab 382 so that the tab 382 is not engaged with the slot 384 and does not interfere with the lateral operating movement of the valve subassembly 372.

As the next stage in the assembly of the vacuum-electric switch 10, the cover 16 is assembled telescopically on and around the rear portion of the case 14, as shown in FIG. 24, so that the rear shaft portion 38 of the rotatable driver 24 is received in the bearing or opening 40 in the cover 16, as previously described. The valve subassembly 372 is positioned as shown in FIGS. 24 and 25, with the rubber valve 228 in sliding engagement with the rear wall 218 of the cover 16, and with the linear flange 244 of the valve carriage 238 slidably received in the forwardly facing channel 246 in the rear wall 218, as previously described.

Figure 19:
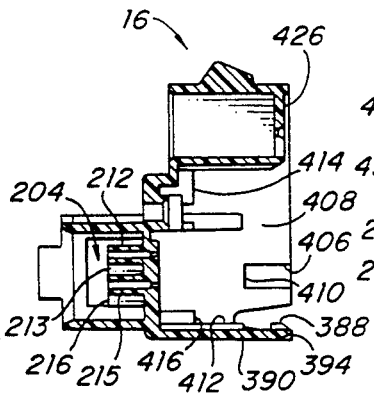
FIG. 19 is a vertical section taken through the cover, generally along the broken line 19—19 in FIG. 20.
Figure 18:
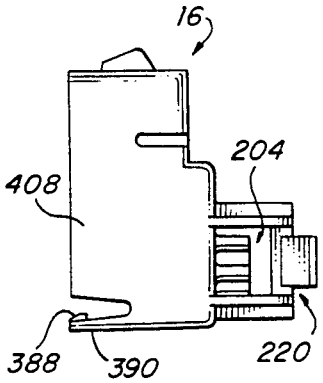
FIG. 18 is a side elevation of the cover.
Figure 17:
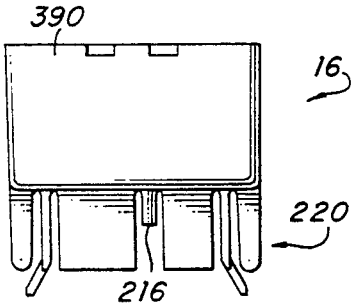

The cover 16 is pushed forwardly into full telescopic engagement on the case 14 and is retained thereon by latching or catch means on the case 14 and the cover 16. As shown in FIGS. 18 and 19, the latching means on the cover 16 include a pair of latching teeth 388 projecting upwardly on the front extremity of a lower wall 390 on the cover 16. The latching teeth 388 are shaped like ratchet teeth and are adapted to snap into a pair of generally rectangular recesses 392 in the underside of the lower wall 282 of the case 14. The cover 16 has a front edge 394 which seats against an outwardly projecting flange 396 on the front wall 18 of the case 14. The recesses 392 comprise some of the latching means on the case 14.

Figure 21:
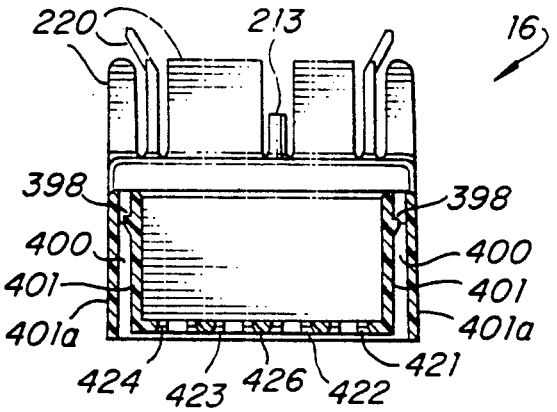
FIG. 21 is a horizontal section, taken generally along the line 21—21 in FIG. 20.

The cover 16 has additional latching means comprising another pair of latching teeth 398 projecting laterally into a pair of tunnels or channels 400 between pairs of spaced side wall portions 401 and 401*a* on the cover 16, as shown in FIG. 21.

As shown in FIGS. 8–11, the case 14 is formed with a pair of rearwardly projecting side wall prongs 402 adapted to be inserted into the open front ends of the tunnels or channels 400. The prongs 402 are formed with latching recesses 404 on the laterally inner sides of the prongs 402, for receiving and interlocking with the latching teeth 398 on the cover 16. The cover 16 is securely retained on the case 14 by the combined latching action of the latching teeth 388, the latching recesses 392, the latching teeth 398, and the latching recesses 404.

The contact plates 104, 106, 130 and 132 are securely retained or clamped between the case 14 and the cover 16, so that the contact plates are maintained in their proper positions despite the rather strong resilient biasing forces produced by the coil springs 188 and 190. As previously described, the laterally projecting locating tabs 126 and 128 on the contact plate 106 are received in respective slots 286 and 288 in the corresponding side walls 278 and 280 of the case 14. The locating tabs 126 and 128 are adapted to engage the shoulders 290 and 292 which also constitute the front edges of the slots 286 and 288. The locating tabs 126 and 128 are long enough to project laterally outwardly beyond the side walls 278 and 280 of the case 14.

Figure 22:
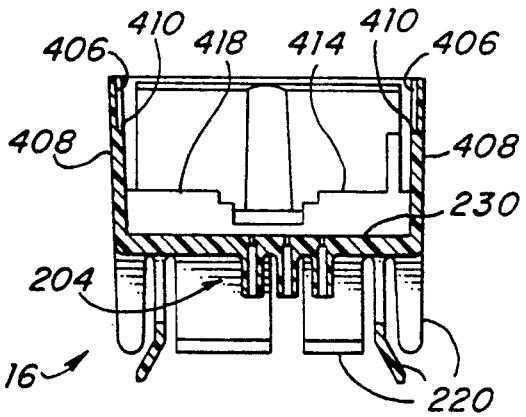
FIG. 22 is a horizontal section, taken generally along the line 22—22 in FIG. 20.
Figure 23:
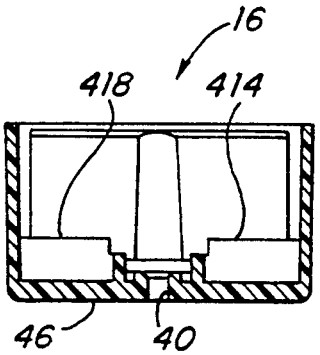
FIG. 23 is a horizontal section, taken generally along the line 23—23 in FIG. 20.

As shown in FIGS. 19 and 22, the cover 16 is formed with a pair of channels 406 formed in the inner sides of a pair of side walls 408. The channels 406 are adapted to receive the outwardly projecting end portions of the locating tabs 126 and 128, which are engageable by a pair of shoulders 410 constituting the rear ends of the channels 406. The tabs 126 and 128 are confined or clamped between the shoulders 410 and the previously described shoulders 290 and 292, constituting the front edges of the slots 286 and 288 in the case 14.

As previously described, the contact plate 104 has downwardly projecting tabs 116 and 118 which are received in slots 294 and 296 in the lower wall 282 of the case 14 and are seated against shoulders 290 and 292 constituting the front edges of the slots 286 and 288. As shown in FIGS. 19 and 20, the lower wall 390 of the cover 16 is formed with a pair of upwardly projecting ridges 412 which are adapted to enter the slots 294 and 296 and to press the downwardly projecting tabs 116 and 118 against the shoulders 298 and 300.

As previously described, the contact plate 130 of FIG. 32 is formed with downwardly projecting tabs 154 and 156 which are adapted to engage rear edge portions 320 and 322 of the lower wall 282 on the case 14. As shown in FIG. 20, the lower wall 390 of the cover 16 is formed with a pair of forwardly facing shoulders 413, adapted to press the tabs 154 and 156 in a forward direction against the rear edge portions 320 and 322 on the lower wall 282 of the case 14.

As previously described, the contact plate 132 has laterally projecting tabs 158, 160, 164 and 166 adapted to engage the rear edge portions 308, 310, 314 and 316 of the side walls 278 and 280 on the case 14. As shown in FIG. 20, the cover 16 is formed with forwardly facing shoulder elements 414, 416, 418 and 420 for engaging the respective tabs 158, 160, 164 and 166 so as to press the tabs forwardly against the rear edge portions 308, 310, 314 and 316 of the side walls 278 and 280 on the case 14. Thus, the contact plates 130 and 132 are securely clamped or confined between the case 14 and the cover 16.

Figure 15:
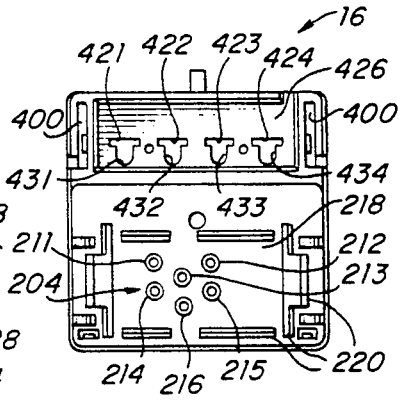
FIG. 15 is a rear elevation of a cover constituting another component of the switch of FIG. 1.

As shown in FIGS. 15 and 20, the cover 16 is formed with slots 421, 422, 423 and 424, through which the respective terminals 171, 172, 173 and 174 project out of the housing 12 and rearwardly from the cover 16. The slots 421, 422, 423 and 424 are formed in a front wall portion 426 of the cover 16. When the cover 16 is mounted on the case 14, the front wall portion 426 engages the rear sides of the respective sheet metal legs 175, 176, 181 and 182 so that the legs are confined between the case 14 and the cover 16. The slots 421, 422, 423 and 424 are shaped so as to have downwardly enlarged portions 431, 432, 433 and 434 through which the resinous plastic mounting pins 303, 304, 327 and 328, respectively, extend rearwardly.

With the aid of a fixture, not shown, the internal switching components of the vacuum-electric switch 10 can be assembled in the reverse order to the order previously described herein. The reverse order of assembly starts with the clutch switch contact and terminal cluster 102, followed by the third contactor 78*c*, the insulating washer 192, the coil spring 190, the second contactor 78*b*, the fan switch contact and terminal cluster 100, the first contactor 78*a*, the coil spring 188 and the rotatable driver 24. After the springs 188 and 190 have been compressed, the E-clip 264 is inserted into the groove 270 in the rotatable driver 24, so as to hold the components in their assembled relation. The assembled components are then inserted into the case 14, as previously described.

Various modifications, alternative constructions and equivalents may be employed, without departing from the true spirit and scope of the invention, as exemplified in the preceding description and defined in the following claims.

I claim:

1. A rotary electrical switch, comprising a housing, a rotatable driver mounted for rotation in said housing, at least first and second electrically conductive sheet metal contact plates fixedly mounted in said housing and extending in a plane substantially perpendicular to said rotatable driver, first and second electrical terminals connected to said contact plates, an electrically conductive sheet metal contactor mounted on said rotatable driver for rotation therewith and for switching engagement with said first and second contact plates, spring means for resiliently pressing said contactor against said contact plates, a narrow temporary connecting web formed initially in one piece with said first and second contact plates to facilitate assembly of the electrical switch, said web being easily removable in the final stages of assembly, and first and second interlocking hook means bent rectangularly from said respective first and second contact plates for strictly limiting relative movement of said first and second contact plates to avoid bending of said web during the assembly of the switch.

2. A switch according to claim 1, said first and second hook means comprising first and second sheet metal hooks bent rectangularly from said first and second contact plates, said first and second hooks being coplanar and having interengageable portions with a narrow gap therebetween.

3. A switch according to claim 1, said interlocking hook means comprising first and second coplanar hooks bent rectangularly from said respective first and second contact plates, said first and second hooks having a narrow gap therebetween, said first and second hooks having interengageable portions on opposite sides of said narrow gap for limiting relative movement of said first and second contact plates.

4. A switch according to claim 3, in which said second hook is connected to an additional flange portion coplanar with said first and second hooks and spaced closely from said first hook, said second hook and said additional flange portion being spaced from said first hook adjacent opposite edges thereof.

5. A switch according to claim 1, in which said hook means comprise a pair of single hooks bent rectangularly from one of said plates and interlocking with a double hook bent rectangularly from the other of said plates, said single hooks and said double hook being coplanar and being separated by narrow gaps.

6. A rotary electrical switch, comprising a housing, a rotatable driver mounted for rotation in said housing, at least first and second electrically conductive sheet metal contact plates fixedly mounted in said housing and extending in a plane substantially perpendicular to said rotatable driver, first and second electrical terminals connected to said contact plates, first and second electrically conductive sheet metal contactors mounted on said rotatable driver for rotation therewith and for switching engagement with opposite sides of said contact plates, first and second spring means for resiliently pressing said contactors against the opposite sides of said contact plates, stop means on said housing and said rotatable driver for limiting said rotatable driver to a particular angular range of rotary movement, said first contact plate extending around said rotatable driver through an angle corresponding to the entire range of rotary movement of said rotatable driver, said contactors having contact riders projecting therefrom for continuous sliding engagement with said first contact plate throughout the entire range of rotary movement of said rotatable driver, said contactors and said rotatable driver having means for rotating said contactors with said rotatable driver throughout the entire range of rotation thereof, each of said contactors having a radially projecting arm thereon, said first contactor having a first rearwardly projecting contact point on said arm thereof for selective sliding engagement with the front sides of said first and second contact plates, said second contactor having a second forwardly projecting contact point on said arm thereof for selective sliding engagement with the rear sides of said first and second contact plates, said first contact plate having at least a first contact sector thereon for sliding engagement by said first and second contact points on opposite sides thereof, said second contact plate having at least a second contact sector thereon for sliding engagement by said first and second contact points on opposite sides of said second sector, said first and second contact points being located at substantially different radial distances from the axis of said rotatable driver, said first and second sectors having substantially radial edges disposed on opposite sides of a substantially radial gap therebetween, said gap being substantially narrower than the width of said first and second contact points so that said contact points can move smoothly across said gap, said first and second contactors being operative to provide a closed and conductive electrical circuit between said first and second contact plates when said first and second contact points are engaging said second sector, said first and second contact points being operative to break said electrical circuit when said first and second contact points are moved across said gap between said second sector and said first sector due to rotation of said rotatable driver, said first and second contact points being aligned so that said contact points break contact with said second sector substantially simultaneously whereby the wear on said contact points and said second sector due to electrical arcing is distributed evenly between said first and second contact points and between the portions of said second sector engaged by said first and second contact points, said first and second contactors being the same in construction and being interchangeable, said contact riders of each of said contactors including a forwardly projecting rider and a rearwardly projecting rider for slidably engaging the first contact plate throughout the angular range of rotation of the rotatable driver and the contactors, each of said contactors having both the first rearwardly projecting contact point and the second forwardly projecting contact point thereon.

7. A rotary electrical switch, comprising a housing, a rotatable driver mounted for rotation in said housing, at least first and second electrically conductive sheet metal contact plates fixedly mounted in said housing and extending in a plane substantially perpendicular to said rotatable driver, first and second electrical terminals connected to said contact plates, first and second electrically conductive sheet metal contactors mounted on said rotatable driver for rotation therewith and for switching engagement with opposite sides of said contact plates, first and second spring means for resiliently pressing said contactor against the opposite sides of said contact plates, stop means on said housing and said rotatable driver for limiting said rotatable driver to a particular angular range of rotary movement, said first contact plate extending around said rotatable driver through an angle corresponding to the entire range of rotary movement of said rotatable driver, each of said contactors having a contact rider projecting therefrom for continuous sliding engagement with said first contact plate throughout the entire range of rotary movement of said rotatable driver, said contactors and said rotatable driver having means for rotating said contactors with said rotatable driver throughout the entire range of rotation thereof, each of said contactors having a radially projecting arm thereon, said first contactor having a first rearwardly projecting contact point on said arm thereof for selective sliding engagement with the front sides of said first and second contact plates, said second contactor having a second forwardly projecting contact point on said arm thereof for selective sliding engagement with the rear sides of said first and second contact plates, said first contact plate having at least a first contact sector thereon for sliding engagement by said first and second contact points on opposite sides thereof, said second contact plate having at least a second contact sector thereon for sliding engagement by said first and second contact points on opposite sides of said second sector, said first and second contact points being located at substantially different radial distances from the axis of said rotatable driver, said first and second sectors having substantially radial edges disposed on opposite sides of a substantially radial gap therebetween, said gap being substantially narrower than the width of said first and second contact points so that said contact points can move smoothly across said gap, said first and second contactors being operative to provide a closed and conductive electrical circuit between said first and second contact plates when said first and second contact points are engaging said second sector, said first and second contact points being operative to break said electrical circuit when said first and second contact points are moved across said gap between said second sector and said first sector due to rotation of said rotatable driver, said first and second contact points being aligned so that said contact points break contact with said second sector substantially simultaneously whereby the wear on said contact points and said second sector due to electrical arcing is distributed evenly between said first and second contact points and between the portions of said second sector engaged by said first and second contact points, said rotatable driver having a contactor-receiving portion of a noncircular cross section for receiving the contactors in a driving relation, each of said contactors having an axial opening therein of a corresponding noncircular shape for receiving the contactor-receiving portion of said rotatable driver, said noncircular contactor-receiving portion being formed with a plurality of nonsymmetrical splines, the noncircular opening in each of said contactors being formed with a plurality of slots disposed in a nonsymmetrical pattern corresponding with the nonsymmetrical pattern of said splines to insure that each of the contactors is correctly positioned in a unique orientation on said rotatable driver.

8. A rotary electrical switch, comprising a housing, a rotatable driver mounted for rotation in said housing, at least first and second electrically conductive sheet metal contact plates fixedly mounted in said housing and extending in a plane substantially perpendicular to said rotatable driver, first and second electrical terminals connected to said contact plates, first and second electrically conductive sheet metal contactors mounted on said rotatable driver for rotation therewith and for switching engagement with opposite sides of said contact plates, first and second spring means for resiliently pressing said contactors against the opposite sides of said contact plates, stop means on said housing and said rotatable driver for limiting said rotatable driver to a particular angular range of rotary movement, said first contact plate extending around said rotatable driver through an angle corresponding to the entire range of rotary movement of said rotatable driver, each of said contactors having a contact rider projecting therefrom for continuous sliding engagement with said first contact plate throughout the entire range of rotary movement of said rotatable driver, said contactors and said rotatable driver having means for rotating said contactors with said rotatable driver throughout the entire range of rotation thereof, each of said contactors having a radially projecting arm thereon, said first contactor having a first rearwardly projecting contact point on said arm thereof for selective sliding engagement with the front sides of said first and second contact plates, said second contactor having a second forwardly projecting contact point on said arm thereof for selective sliding engagement with the rear side of said first and second contact plates, said first contact plate having at least a first contact sector thereon for sliding engagement by said first and second contact points on opposite sides thereof, said second contact plate having at least a second contact sector thereon for sliding engagement by said first and second contact points on opposite sides of said second sector, said first and second contact points being located at substantially different radial distances from the axis of said rotatable driver, said first and second sectors having substantially radial edges disposed on opposite sides of a substantially radial gap therebetween, said gap being substantially narrower than the width of said first and second contact points so that said contact points can move smoothly across said gap, said first and second contactors being operative to provide a closed and conductive electrical circuit between said first and second contact plates when said first and second contact points are engaging said second sector, said first and second contact points being operative to break said electrical circuit when said first and second contact points are moved across said gap between said second sector and said first sector due to rotation of said rotatable driver, said first and second contact points being aligned so that said contact points break contact with said second sector substantially simultaneously whereby the wear on said contact points and said second sector due to electrical arcing is distributed evenly between said first and second contact points and between the portions of said second sector engaged by said first and second contact points, said first and second contactors being provided with respective first and second contact riders for slidably engaging said first contact plate, said first contact rider projecting rearwardly from said first contactor, said second contact rider projecting forwardly from said second contactor.

9. A rotary electrical switch according to claim 8, in which said first and second contactors are the same in construction and are interchangeable, each of said first and second contactors having both said first and second contact riders thereon, each of said first and second contactors having both said first and second contact points thereon, said first and second contact points being aligned along a radial line and spaced radially at different radial distances from the axis of said contactors.

10. A rotary electrical switch, comprising a housing, a rotatable driver mounted for rotation in said housing, at least first and second electrically conductive sheet metal contact plates fixedly mounted in said housing and extending in a plane substantially perpendicular to said rotatable driver, first and second electrical terminals connected to said contact plates, first and second electrically conductive contactors mounted on said rotatable driver for rotation therewith and for switching engagement with opposite sides of said first and second contact plates, first and second spring means for resiliently pressing said first and second contactors against the opposite sides of said contact plates, each of said contactors having a contact rider projecting therefrom for continuous sliding engagement with said first contact plate throughout the entire range of rotary movement of said rotatable driver, said first contactor having a first rearwardly projecting contact point thereon for selective sliding engagement with the front sides of said first and second contact plates, said second contactor having a second forwardly projecting contact point thereon for selective sliding engagement with the rear sides of said first and second contact plates, said first contact plate having at least a first contact sector thereon for sliding engagement by said first and second contact points on opposite sides thereof, said second contact plate having at least a second contact sector thereon for sliding engagement by said first and second contact points on opposite sides of said second sector, said first and second contact points being located at substantially different radial distances from the axis of said rotatable driver, said first and second contact sectors having generally radial edges disposed on opposite sides of a generally radial gap therebetween, said first and second contact points being smoothly movable across said gap, said first and second contactors being operative to provide a closed and conductive electrical circuit between said first and second contact plates when said first and second contact points are engaging said second contact sector, said first and second contact points being operative to break said electrical circuit when said first and second contact points are moved across said gap between said second contact sector and said first contact sector due to rotation of said rotatable driver, said first and second contact points being aligned so that said contact points break contact with said second contact sector substantially simultaneously whereby the wear on said contact points and said second sector due to electrical arcing is distributed evenly between said first and second contact points and between the portions of said second contact sector engaged by said first and second contact points, said first and second contactors being the same in construction and being interchangeable, each of said contactors having rider means for slidably engaging the first contact plate throughout the angular range of rotation of the rotatable driver and the contactors, each of said contactors having both the first rearwardly projecting contact point and the second forwardly projecting contact point thereon.

11. A rotary electrical switch, comprising a housing, a rotatable driver mounted for rotation in said housing, at least first and second electrically conductive sheet metal contact plates fixedly mounted in said housing and extending in a plane substantially perpendicular to said rotatable driver, first and second electrical terminals connected to said contact plates, first and second electrically conductive contactors mounted on said rotatable driver for rotation therewith and for switching engagement with opposite sides of said first and second contact plates, first and second spring means for resiliently pressing said first and second contactors against the opposite sides of said contact plates, each of said contactors having a contact rider projecting therefrom for continuous sliding engagement with said first contact plate throughout the entire range of rotary movement of said rotatable driver, said first contactor having a first rearwardly projecting contact point thereon for selective sliding engagement with the front sides of said first and second contact plates, said second contactor having a second forwardly projecting contact point thereon for selective sliding engagement with the rear sides of said first and second contact plates, said first contact plate having at least a first contact sector thereon for sliding engagement by said first and second contact points on opposite sides thereof, said second contact plate having at least a second contact sector thereon for sliding engagement by said first and second contact points on opposite sides of said second sector, said first and second contact points being located at substantially different radial distances from the axis of said rotatable driver, said first and second contact sectors having generally radial edges disposed on opposite sides of a generally radial gap therebetween, said first and second contact points being smoothly movable across said gap, said first and second contactors being operative to provide a closed and conductive electrical circuit between said first and second contact plates when said first and second contact points are engaging said second contact sector, said first and second contact points being operative to break said electrical circuit when said first and second contact points are moved across said gap between said second contact sector and said first contact sector due to rotation of said rotatable driver, said first and second contact points being aligned so that said contact points break contact with said second contact sector substantially simultaneously whereby the wear on said contact points and said second sector due to electrical arcing is distributed evenly between said first and second contact points and between the portions of said second contact sector engaged by said first and second contact points, said rotatable driver having a contactor-receiving portion of a noncircular nonsymmetrical cross section for receiving the contactors in a driving relation, each of said contactors having an axial opening therein of a corresponding noncircular nonsymmetrical shape for receiving the contactor-receiving portion of said rotatable driver to insure that each of the contactors is correctly positioned in a unique orientation on said rotatable driver with said first and second contact points aligned.

12. A rotary electrical switch, comprising a housing, a rotatable driver mounted for rotation in said housing, at least first and second electrically conductive sheet metal contact plates fixedly mounted in said housing and extending in a common plane substantially perpendicular to said rotatable driver, each of said contact plates having opposite front and rear sides thereof exposed and accessible in said housing, first and second electrical terminals connected to said contact plates, first and second electrically conductive contactors mounted on said rotatable driver for rotation therewith and for switching engagement with the opposite sides of both of said first and second contact plates, first and second spring means for resiliently pressing said first and second contactors against the opposite sides of said contact plates, each of said contactors having a contact rider projecting therefrom for continuous sliding engagement with said first contact plate throughout the entire range of rotary movement of said rotatable driver, said first contactor having a first rearwardly projecting contact point thereon for selective sliding engagement with the front sides of said first and second contact plates, said second contactor having a second forwardly projecting contact point thereon for selective sliding engagement with the rear sides of said first and second contact plates, said first contact plate having at least a first contact sector thereon for sliding engagement by said first and second contact points on opposite sides thereof, said second contact plate having at least a second contact sector thereon for sliding engagement by said first and second contact points on opposite sides of said second sector, said first and second contact points being located at substantially different radial distances from the axis of said rotatable driver, said first and second contact sectors having generally radial edges disposed on opposite sides of a generally radial gap therebetween, said first and second contact points being smoothly and substantially simultaneously movable across said gap, said first and second contactors being operative to provide separate parallel closed and conductive electrical circuits between said first and second contact plates when said first and second contact points are engaging the opposite sides of said second contact sector, said first and second contact points being operative to break said separate parallel electrical circuits substantially simultaneously when said first and second contact points are moved across said gap between said second contact sector and said first contact sector due to rotation of said rotatable driver, said first and second contact points being generally radially aligned so that said contact points break contact with said second contact sector substantially simultaneously whereby the wear on said contact points and said second sector due to electrical arcing is distributed evenly between said first and second contact points and between the portions of said second contact sector engaged by said first and second contact points.

13. A rotary electrical switch according to claim 12, in which said first and second contactors are the same in construction and are interchangeable, each of said contactors having a first rearwardly projecting contact rider and a second forwardly projecting contact rider for slidably engaging the first contact plate throughout the angular range of rotation of the rotatable driver and the contactors, each of said contactors having both the first rearwardly projecting contact point and the second forwardly projecting contact point thereon.

14. A rotary electrical switch according to claim 12, including at least one additional contact sector separated from said first contact sector by an additional narrow generally radial gap, said first and second contact points being movable smoothly and substantially simultaneously across said additional narrow gap, said first sector and said additional sector having first and second additional edges on opposite sides of said additional gap, said additional edges being generally radial so that said first and second contact points break contact simultaneously with said additional edge on said additional sector whereby the wear is distributed evenly between the portions of the additional sector which are engageable by said first and second contact points, and also between said first and second contact points.

15. A rotary electrical switch according to claim 12, in which said rotatable driver has a contactor-receiving portion of a noncircular nonsymmetrical cross section for receiving the contactors in a driving relation, each of said contactors having an axial opening therein of a corresponding noncircular nonsymmetrical shape for receiving the contactor-receiving portion of said rotatable driver.

16. A rotary electrical switch according to claim 15, in which said noncircular nonsymmetrical contactor-receiving portion is formed with a plurality of nonsymmetrical splines, the noncircular nonsymmetrical opening in each of said contactors being formed with a plurality of slots disposed in a nonsymmetrical pattern corresponding with the nonsymmetrical pattern of said splines to insure that each of the contactors is correctly positioned in a unique orientation on said rotatable driver.

17. A rotary electrical switch according to claim 12, including at least one additional contact sector separated from said first contact sector by an additional generally radial narrow gap, the width of said additional gap being substantially narrower than the width of said contact points so that said contact points will move smoothly across said additional narrow gap, said first sector and said additional sector having first and second additional edges on opposite sides of said additional gap, said additional edges being generally radial so that said first and second contact points break contact substantially simultaneously with said additional edge on said additional sector whereby the wear is distributed evenly between the portions of the additional sector which are engageable by said first and second contact points, and also between the first and second contact points.

18. A rotary electrical switch according to claim 12, in which said second contact plate has at least one additional contact sector for sliding engagement by said first and second contact points on the respective first and second contactors, said first contact sector and said additional contact sector having corresponding additional opposite edges with an additional narrow gap therebetween, the width of said additional narrow gap being substantially less than the width of the first and second contact points so that said points can ride smoothly across said additional gap, said additional edges and said additional gap being generally radial so that said first and second contact points break contact substantially simultaneously with said additional edge on said additional contact sector when said contact points are moved between said additional contact sector and said first contact sector, whereby the wear is evenly distributed between said first and second contact points and also between the portions of said additional edge which are engageable by said contact points.

19. A rotary electrical switch according to claim 12, including third and fourth electrically conductive contact plates spaced along said rotatable driver from said first and second contact plates and aligned in a second plane substantially perpendicular to the axis of the rotatable driver, said third and fourth contact plates having corresponding third and fourth electrical terminals thereon, a third electrically conductive sheet metal contactor mounted on said rotatable driver for rotation therewith in sliding engagement with said third and fourth contact plates, said spring means including means for biasing said third contactor against said third and fourth contact plates, said third contactor having a third contact rider for slidably engaging said third contact plate throughout the angular range of rotation of said rotatable driver, said third contactor having a third contact point projecting therefrom for slidably and selectively engaging said third and fourth contact plates, said third and fourth contact plates having at least third and fourth contact sectors thereon for selective engagement by said third contact point.

20. A rotary electrical switch according to claim 19, in which said spring means comprise a first coil spring received around said driver and acting between said first contactor and said third contactor for biasing said first contactor against the front sides of said first and second contact plates while biasing said third contactor against said third and fourth contact plates, and a second coil spring received around said driver and acting against said second contactor for biasing said second contactor against the rear sides of said first and second contact plates.

21. A rotary electrical switch according to claim 20, in which said driver is made of an electrically insulating material, and in which electrical insulation is provided between said first coil spring and one of said first and third contactors to prevent said first coil spring from establishing an electrically conductive path between said first and third contactors.

* * * * *